US006418290B1

(12) United States Patent
Isomura et al.

(10) Patent No.: US 6,418,290 B1
(45) Date of Patent: Jul. 9, 2002

(54) DEVELOPER AGITATING SHEET AND DEVELOPER CONTAINER

(75) Inventors: Tetuo Isomura, Shizuoka-ken; Yutaka Ban, Tokyo; Katsuya Murakami, Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/697,715

(22) Filed: Oct. 27, 2000

(30) Foreign Application Priority Data

Oct. 29, 1999 (JP) ..... 11-309932

(51) Int. Cl.[7] ..... G03G 15/08
(52) U.S. Cl. ..... 399/254; 399/263
(58) Field of Search ..... 399/107, 254, 399/256, 263

(56) References Cited

U.S. PATENT DOCUMENTS 4,981,218 A 1/1991 Ban et al. ..... 206/633
5,351,728 A 10/1994 Ban et al. ..... 141/364
5,579,101 A 11/1996 Omata et al. ..... 355/260
5,832,342 A * 11/1998 Hazama et al. ..... 399/107
5,870,652 A 2/1999 Kanamori et al. ..... 399/106
6,088,561 A * 7/2000 Kawamura et al. ..... 399/263 X
6,128,453 A * 10/2000 Ban et al. ..... 399/263 X
6,131,008 A 10/2000 Kanamori et al. ..... 399/263
6,246,854 B1 * 6/2001 Kurosawa et al. ..... 399/263

FOREIGN PATENT DOCUMENTS

JP 10-20668 * 1/1998

* cited by examiner

*Primary Examiner*—Fred L Braun

(57) ABSTRACT

The present invention provides a rotatable agitating sheet for agitating a developer contained in a developer container, which has a first sheet portion for rubbing an inside wall of the developer container substantially in parallel with a rotation axis of the agitating sheet, a second sheet portion for rubbing an inside wall of the developer container intersecting with the rotation axis line of the agitating sheet, the second sheet portion being continuous to the first sheet portion, and a slit extending inward from an end of the agitating sheet and being formed between the first sheet portion and the second sheet portion.

15 Claims, 20 Drawing Sheets

301h
301a
303e
303
306
301j
301E
301l
301e
301
301A
301m
301f
301D
301c
301b2
301k
301b1
301F
301G
301H
305
305a
305b
305c
302
309
309a
310
311
301i
308
301k 301E
301g
301h
301j
301e 301A
301A1
301h
301m
301k
301a
301g
301k
301j
301E
301J
301e
301B
301f 301E
301k
301c
301j
301m
301a

301A1
301n
301h
301a
301g
301D
301E
301c
301B
301b2
301i
301b1

301j
301m
301n
301E
301j
301F
301G
301H 301j
301m
301E
301l
301c
301j
301l

θ1=26°

DEVELOPER AGITATING SHEET AND DEVELOPER CONTAINER

BACKGROUND OF THE INVENTION

1. Field of the Invention

The present invention relates to a developer container which is used for replenishing a developing apparatus of an electronic image forming apparatus such as an electrostatic copying machine or a printer with a developer, and a developer agitating sheet which is suited for use in the developer container.

2. Related Background Art

A fine powder toner has conventionally been used as a developer for an electronic image forming apparatus such as an electrostatic copying machine or a printer (hereinafter referred to as an image forming apparatus). When the developer is consumed in a main body of the image forming apparatus, the toner is replenished into the image forming apparatus using a toner replenishing container which is a toner container. The toner replenishing container is configured by a cylindrical or regularly parallelepipedous main body of the container which is generally made of synthetic resin, a closing member which has an aperture portion open for replenishing the toner from the main body of the container into a developing apparatus, an agitating member which carries the toner from inside the main body of the container toward the aperture portion and a carrying member. Furthermore, there has been prepared a process cartridge which integrates a toner replenishing container with a photosensitive drum, a cleaning device, a charging device and the like, and is used in a main body of the image forming apparatus.

Since the toner is a remarkably fine powder, it poses a problem that it is splashed and soils an operator and surroundings during a toner replenishing work. Accordingly, there has been proposed and put to practical use a conventional type toner container which is installed in the main body of the image forming apparatus like the process cartridge and discharges the toner through an aperture.

In case of the above described toner replenishing container which is cylindrical or regularly parallelepipedous, the agitating member is equipped on a tip with blades (agitating sheets) consisting of flexible members which rub inside wall surfaces of the container to discharge a contained developer. The blades consisting of the flexible members are prepared as blades used for rubbing walls surfaces which are in parallel with a longitudinal direction and perpendicular to the longitudinal direction respectively of the container, that is, three or more flexible blades are disposed on the tip of the agitating member.

However, the conventional type toner replenishing container poses problems which are described below.

The agitating member disposed in the toner replenishing container has at least a blade for rubbing (sliding frictionally) the wall surface in parallel with the longitudinal direction of the container and two blades for rubbing the wall surfaces perpendicular to the longitudinal direction of the container, thereby increasing a number of parts of the toner replenishing container and enhancing a manufacturing cost of the toner replenishing container. When the blades which rub the surfaces perpendicular to the longitudinal direction are simply omitted, the toner remains in the replenishing container after discharge in an amount larger on the order of lOg than an amount of the toner which remains in a toner replenishing container in which the blades are not omitted.

SUMMARY OF THE INVENTION

An object of the present invention is to provide an agitating sheet which allows a number of parts to be reduced and a developer container which uses the agitating sheet.

Another object of the present invention is to provide an agitating sheet which exhibits enhanced developer agitating performance even when the sheet is used in a singularity and a developer container which has the agitating sheet.

Still another object of the present invention is to provide a toner agitating sheet and a developer container which permit omitting sheets used exclusively for rubbing container wall surfaces intersecting with a direction of a rotating axis without degrading developer discharging performance.

DETAILED DESCRIPTION OF THE PREFERRED EMBODIMENTS (First Embodiment)

Now, an embodiment of the present invention will be described with reference to the accompanying drawings.

On the basis of FIG. 1, a description will be made first of an electronic photograph copying machine as an example of an electronic photograph forming apparatus in which the toner replenishing container according to the present invention is to be disposed.

Figure 1:
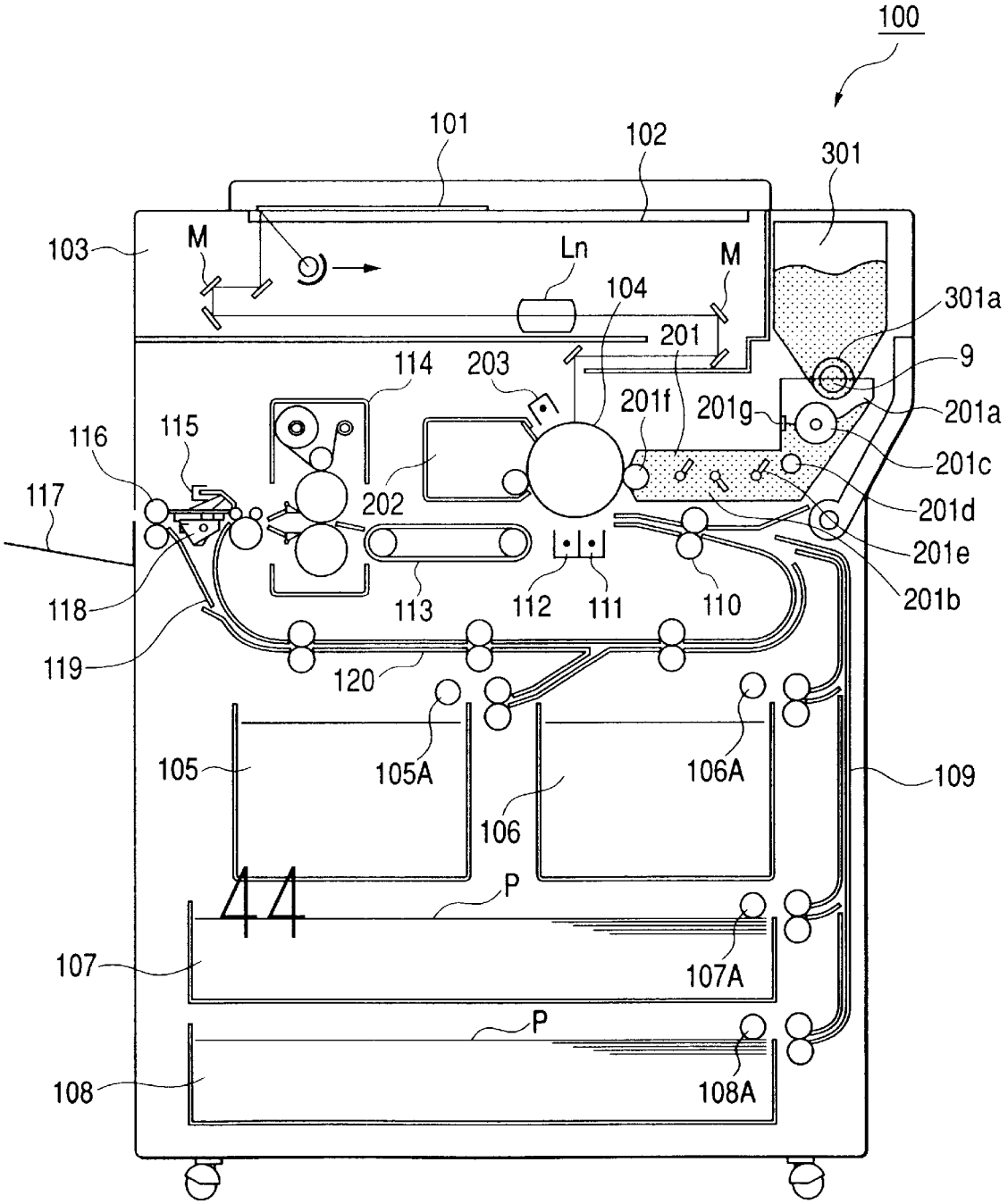
FIG. 1 is a longitudinal sectional view showing a configuration of an electronic photograph copying machine as an example of an electronic photograph image forming apparatus in which a toner replenishing container according to the present invention is disposed.

In FIG. 1, reference numeral 100 denotes a main body of an electronic photograph copying machine (hereinafter referred to as a main body of the apparatus). Furthermore, reference numeral 101 denotes an original placed on an original base glass plate 102. An optical image corresponding to image information is formed on an electronic photograph photosensitive drum 104 by a plurality of mirrors M and a lens Ln of an optical portion 103. Reference numerals 105 through 108 denote cassettes. Out of recording media (hereinafter referred to as "sheets") P mounted on these cassettes 105 through 108, an optimum sheet is determined from paper size information of the cassettes 105 through 108 on the basis of information input by a user from an operating portion 100*a* shown in FIG. 2 or a paper size of the original 101. The recording medium P is not limited by the sheets and may be selected appropriately, for example, from among OHP sheets. In addition, reference numeral 100b denotes display means which displays an operated command or a state of the image forming apparatus.

A sheet P which is carried by sheet feeding and separating apparatuses 105A through 108A is carried to a registration roller 110 by way of a sheet carrying portion 109 and then carried while synchronizing rotation of the photosensitive drum 104 with scanning by the optical section 103. Reference numerals 111 and 112 denote a transferring discharger and a separating discharger. A toner image formed on the photosensitive drum 104 is transferred to the sheet P by the transferring discharger 111. The sheet P to which the toner image is transferred is separated from the photosensitive drum 104 by the separating discharger 112.

The sheet P which is carried by a carrying section 113 is then heated and pressurized in a fixing portion 114 to fix the toner image on the sheet, passes through a sheet discharging reversing portion 115 and is discharged into a sheet discharge tray 117 by sheet discharging rollers 116 in case of single surface copying. In case of two-sided copy (double surface copying), the sheet P is carried to the registration roller 110 by way of refeeding carriage paths 119 and 120 under control by a flapper 118 of the sheet discharging reversing portion 115, and then discharged into the sheet discharge tray 117 through a path which is the same as that in the case of single surface copying.

In case of multiple copying, the sheet P passes through the sheet discharging reversing portion 115 and is partially discharged once outside the apparatus by the sheet discharging rollers 116. At a timing when a terminal end of the sheet P has passed over the flapper 118 and is still sandwiched between the sheet discharging rollers 116, the sheet P is carried again into the apparatus by controlling the flapper 118 and rotating the sheet discharging rollers 116 reversely. After being carried further to the registration roller 110 by way of the refeeding carriage paths 119 and 120, the sheet P is discharged into the sheet discharge tray 117 by way of the path which is the same as that in case of single surface copying.

In the main body of the apparatus 100 which has the above described configuration, a developing portion 201, a cleaning device 202, a primary charging device (electrifier) 203 and the like are disposed around the photosensitive drum 104. Using a toner, the developing portion 201 develops an electrostatic latent image which is formed on the photosensitive drum 104 by the optical portion 103 using information of the original 101. As a developer container which replenishes the developing portion 201 with the toner, the toner container 301 is provided detachably and attachably to the main body 100 of the apparatus by a user. The developing portion 201 has a toner hopper 201*a* and a developing device 201*b*. The toner hopper 201*a* has an agitating member 201*c* which has a screw blade 201*g* used for agitating the toner replenished from a toner replenishing aperture portion 301*a* of the toner replenishing container 301 through a toner receiving port 9 of the toner hopper 201. The toner which is agitated by the agitating member 201*c* is sent to the developing device 201*b* by a magnet roller 201*d*. The developing device 201*b* has a developing roller 201*f* and a feeding member 201*e*. The toner which is fed from the toner hopper 201*a* by the magnet roller 201*d* is sent to the developing roller 201*f* by the feeding member 201*e* and supplied to the photosensitive drum 104 by the developing roller 201*f*.

The cleaning device 202 removes residual toner from the photosensitive drum 104. Furthermore, the primary electrifier 203 electrifies the photosensitive drum 104.

Figure 2:
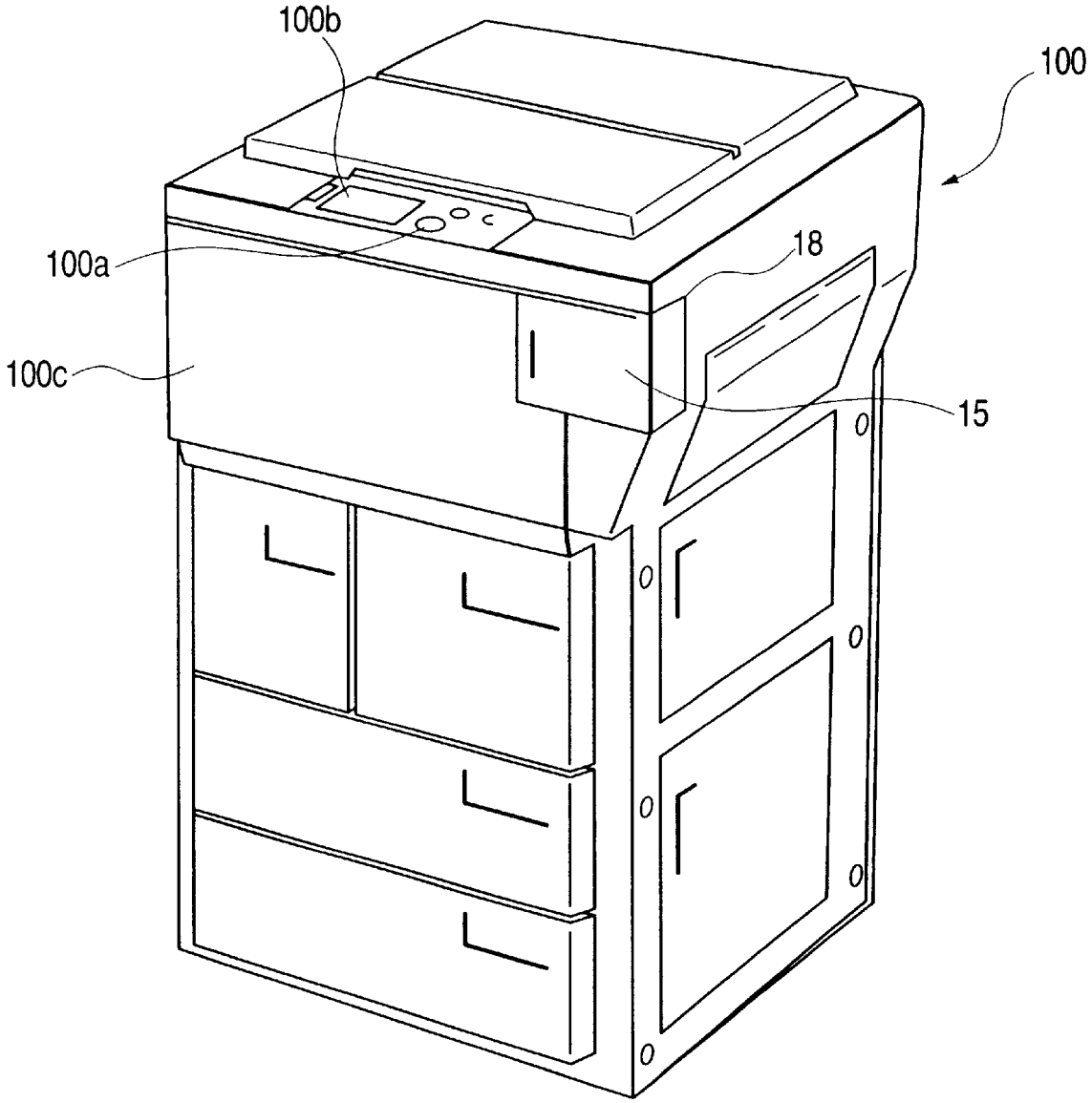
FIG. 2 is a perspective view showing an appearance of the above described electronic photograph copying machine.
Figure 3:
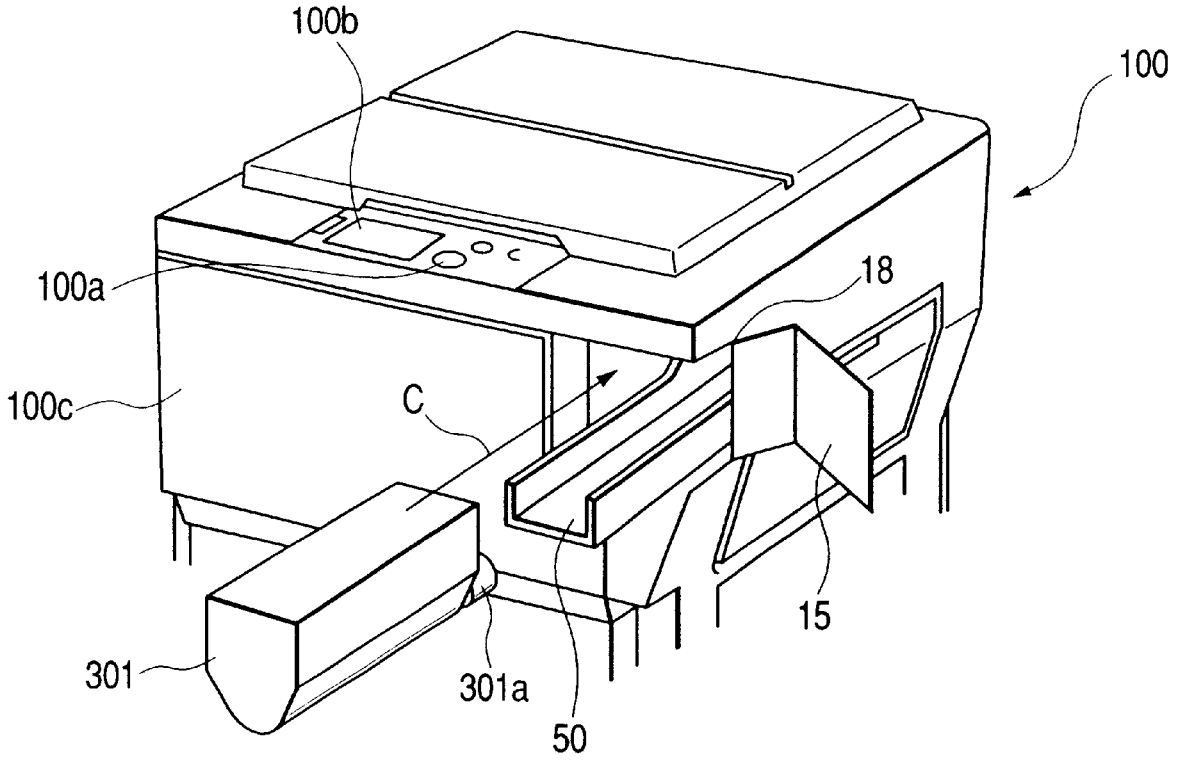
FIG. 3 is a perspective view showing a manner to dispose the toner replenishing container into the electronic photograph copying machine with a toner replenishing exchanging cover of the above described electronic photograph copying machine kept open.

When the user opens a toner replenishing container cover 15 (hereinafter referred to as an exchanging cover) which is a portion of a sheath cover hinged to the apparatus main body 100 with a hinge 18 shown in FIG. 2, a container receiving stand 50 is drawn out to a predetermined position by a driving system (not shown) as shown in FIG. 3. The toner replenishing container 301 is placed on the container receiving stand 50 by inserting in a direction indicated by an arrow C. When the user is to take out the toner replenishing container 301 from the main body 100 of the apparatus, the user takes the toner replenishing container 301 out of the container receiving stand 50 which is drawn out. The exchanging cover 15 is opened and closed only for attaching and detaching the toner replenishing container 301. A front cover 100*c* is opened and closed for maintenance of the apparatus main body.

In addition, the toner replenishing container 301 may be configured so as to be disposed directly in the main body of the apparatus and taken out of the main body 100 of the apparatus not by way of the container receiving stand 50.

[Overall Configuration of Toner Replenishing Container]

Now, a description will be made of a toner replenishing container according to the embodiment.

Figure 4A:
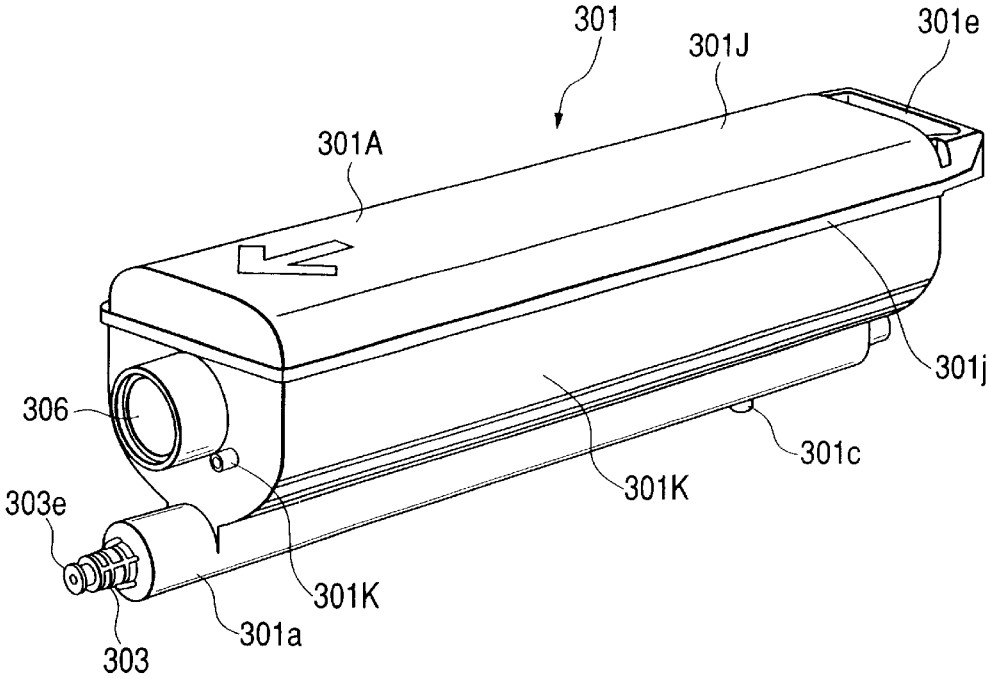
FIG. 4A is a perspective view of a toner replenishing container according to a first embodiment of the present invention as seen from a side of a closing member and FIG. 4B is a perspective view of the toner replenishing container according to the embodiment of the present invention as seen from a side of a grip.
Figure 4B:
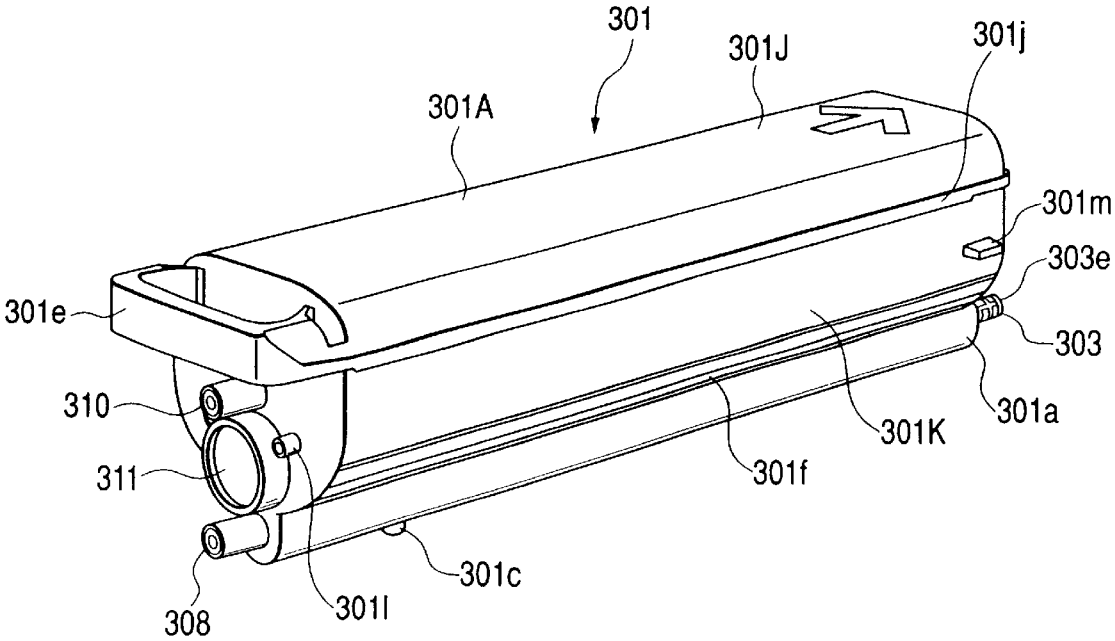

FIGS. 4A and 4B are perspective views of the toner replenishing container 301 according to the embodiment.

Figures 5A, 5B, 5C, 5D, 5E, 5F:
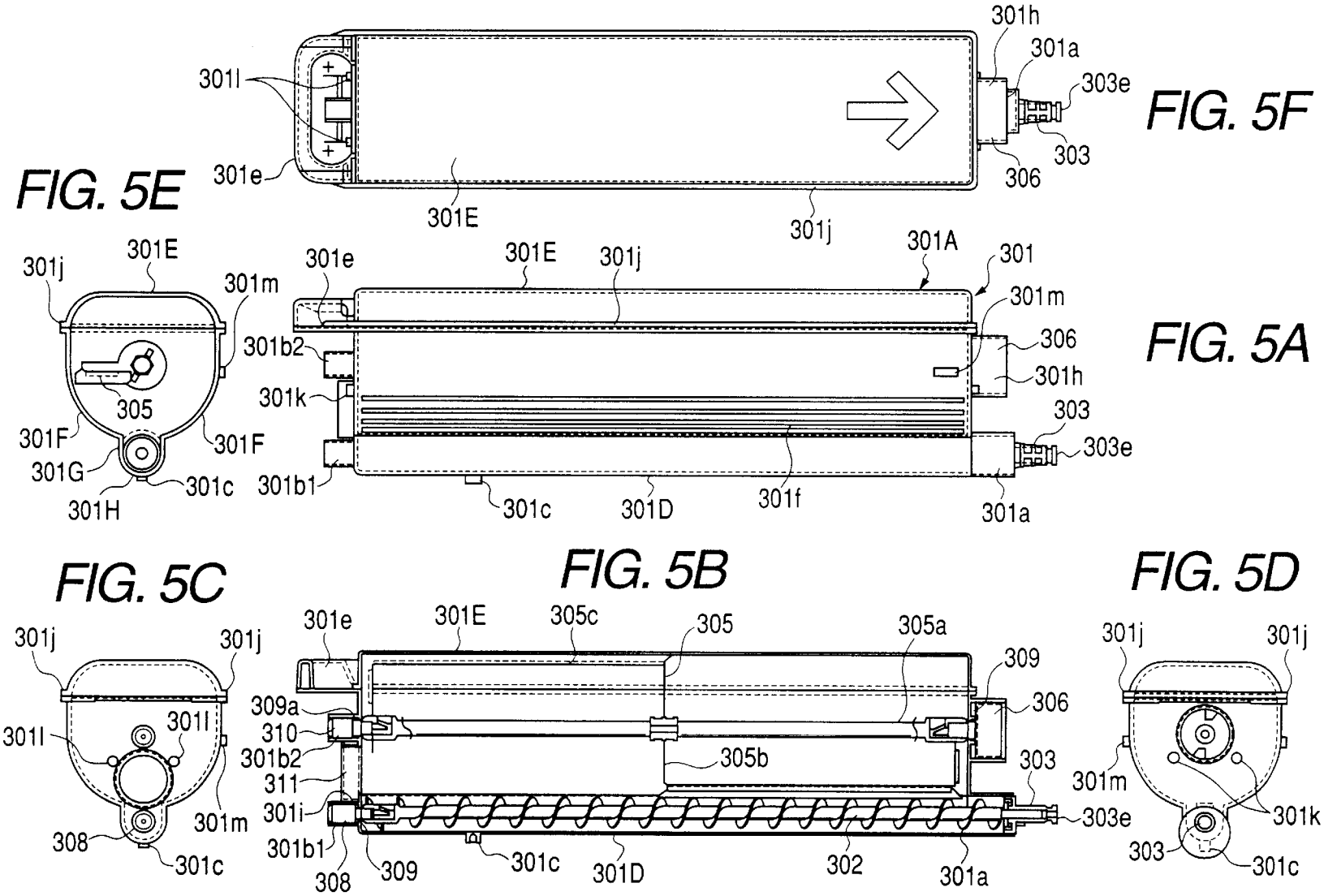
FIG. 5A is a front view.
FIG. 5B is a longitudinal sectional view.
FIG. 5C is a left side view.
FIG. 5D is a right side view.
FIG. 5E is a side sectional view and FIG. 5F is a plan view of the toner replenishing container according to the first embodiment of the present invention.
Figure 6:
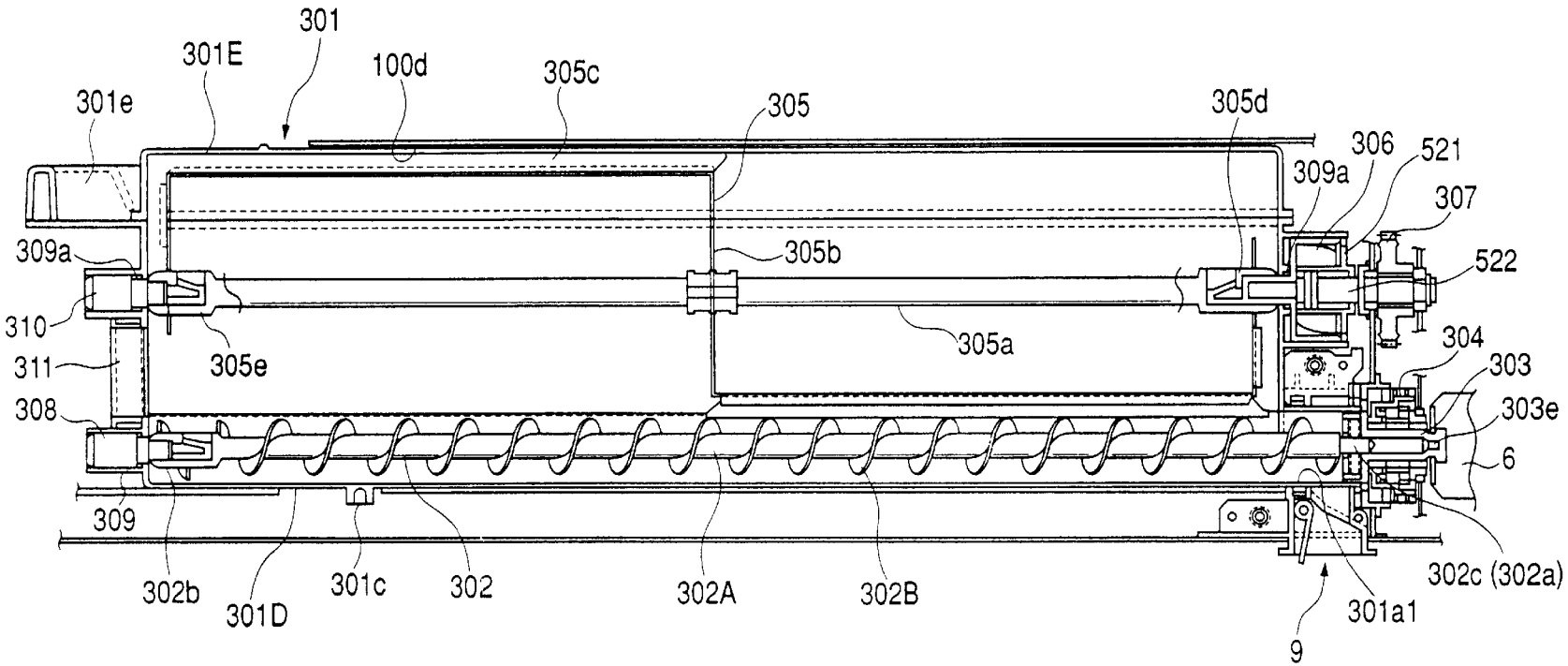
FIG. 6 is a front sectional view of the toner replenishing container in a condition where the container is disposed in a main body of an apparatus and a replenishing aperture portion is sealed.
Figure 7:
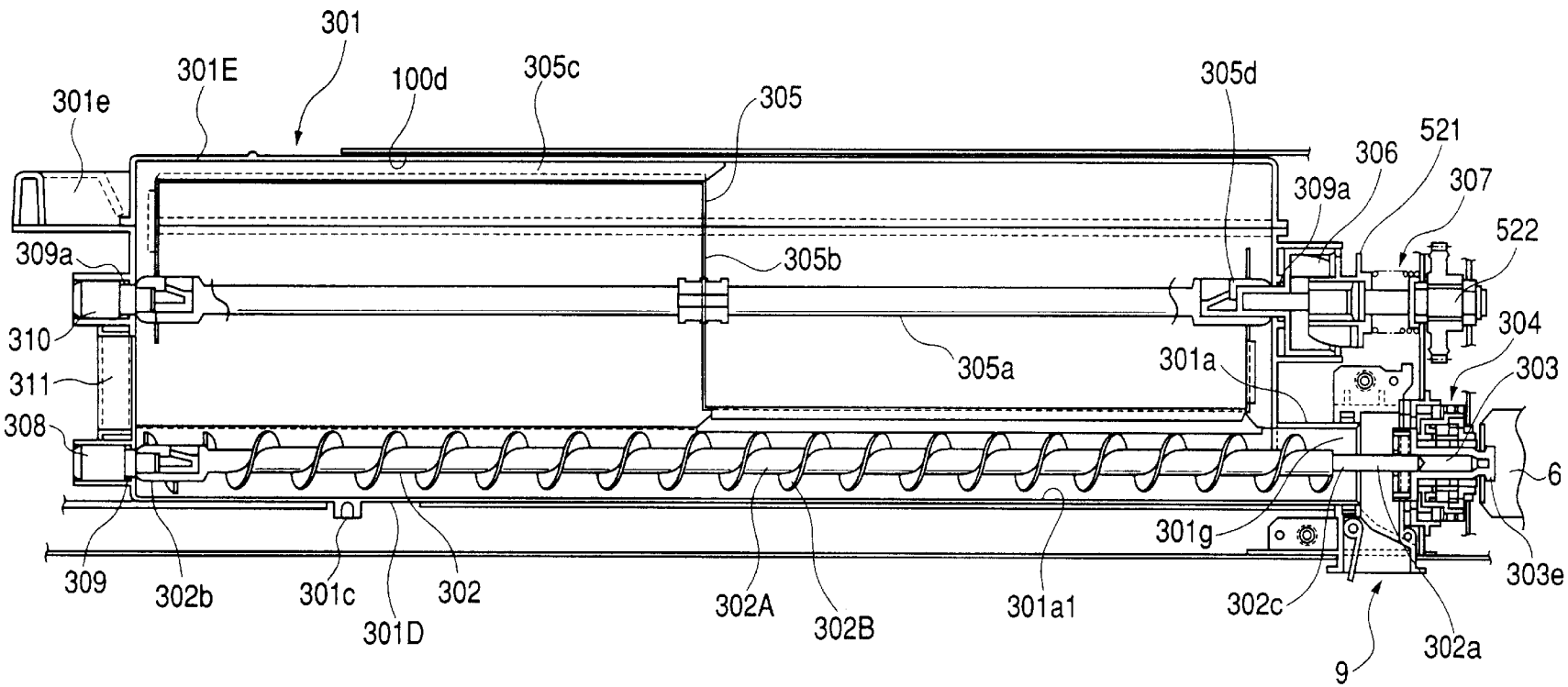
FIG. 7 is a front view of the toner replenishing container in a condition where the container is disposed in the main body of the apparatus and the replenishing aperture portion is unsealed.

Furthermore, FIG. 5A is a front view of the toner replenishing container according to the embodiment and FIG. 5B is a sectional view of the toner replenishing container. FIG. 5C is a left side view of the toner replenishing container, FIG. 5D is a right side view of the toner replenishing container, FIG. 5E is a side sectional view of the toner replenishing container and FIG. 5F is a plan view of the toner replenishing container. FIG. 6 is a front sectional view of the toner replenishing container in a condition where the toner replenishing container is disposed in the main body 100 of the apparatus and a replenishing aperture is sealed. Furthermore, FIG. 7 is a front view of the toner replenishing container in a condition where the toner replenishing container is disposed in the main body 100 of the apparatus and the replenishing aperture is unsealed.

In FIGS. 4A, 4B, 5A, 5B, 5C, 5D, 5E, 5F, 6 and 7, reference numeral 301A denotes a main body of the container and a reference numeral 302 denotes a carrying member for carrying the toner accommodated in the main body 301A of the container toward a toner replenishing aperture portion 301*a*. The carrying member 302 is a screw which has a screw blade. Reference numeral 303 denotes a closing member for closing a toner replenishing port 301*g* shown in FIG. 8A and reference numeral 304 shown in FIG. 6 denotes a coupling member which transmits a driving force to the closing member 303 when the toner replenishing container 301 is disposed in the main body 100 of the apparatus. Reference numeral 305 denotes a rotating agitating member (hereinafter referred to as an agitating member) which agitates the toner in the main body 301A of the container. Reference numeral 306 denotes a transmitting member which is engaged with the agitating member 305 and transmits a rotating drive force from the image forming apparatus to the agitating member 305. Reference numeral 307 denotes a second coupling member which transmits the driving force to the transmitting member 306 when the toner replenishing container 301 is disposed in the main body 100 of the apparatus.

Furthermore, reference numeral 309 denotes an oil seal for preventing the toner from leaking.

Figure 8A:
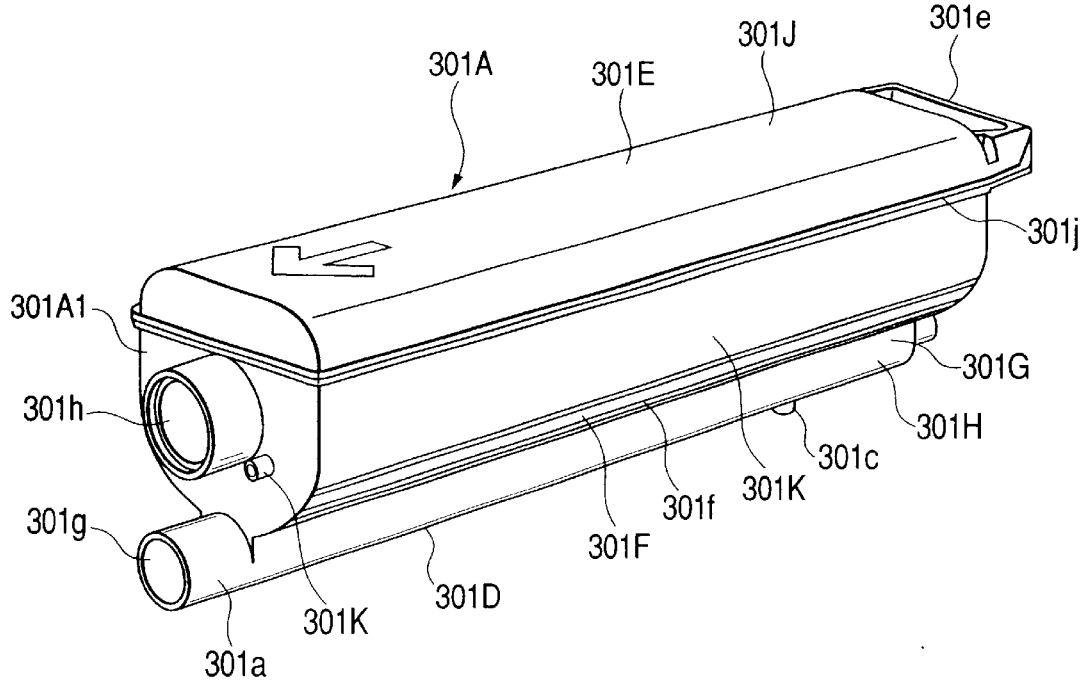
FIG. 8A is a perspective view of a toner container part according to the first embodiment of the present invention as seen from a side of the replenishing aperture portion and FIG. 8B is a perspective view of the toner container part as seen from the side of the grip.
Figure 8B:
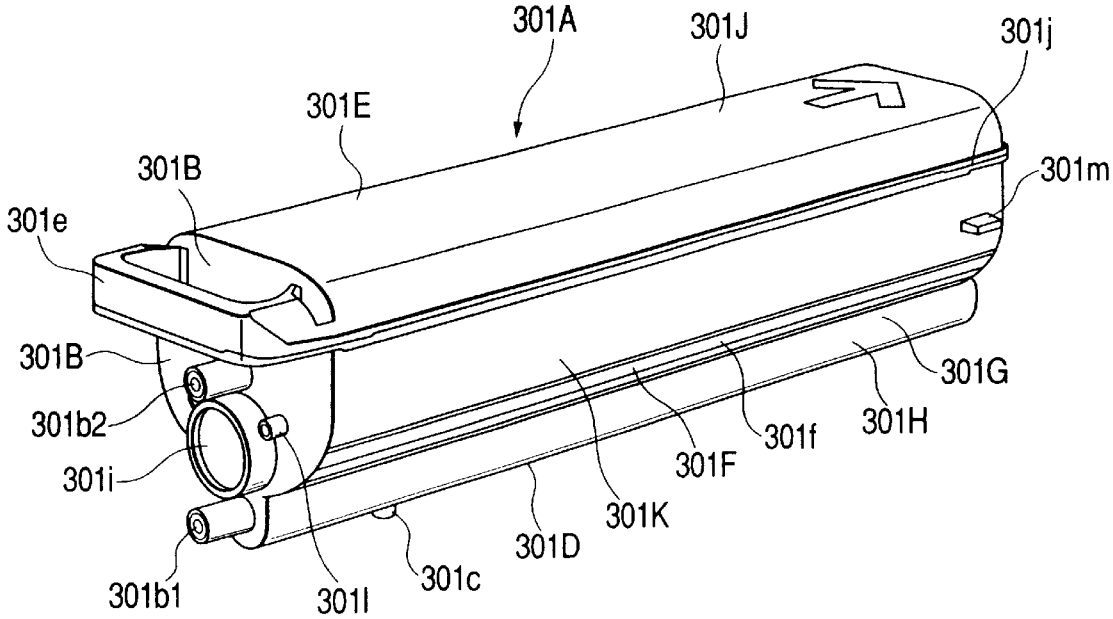

Description will be made here of a toner replenishing container part 301A which is the main body of the toner replenishing container with reference to FIGS., 8A, 8B, 9A, 9B, 9C, 9D, 9E and 9F. FIGS. 8A and 8B are perspective views of the main body of the container.

Figures 9A, 9B, 9C, 9D, 9E, 9F:
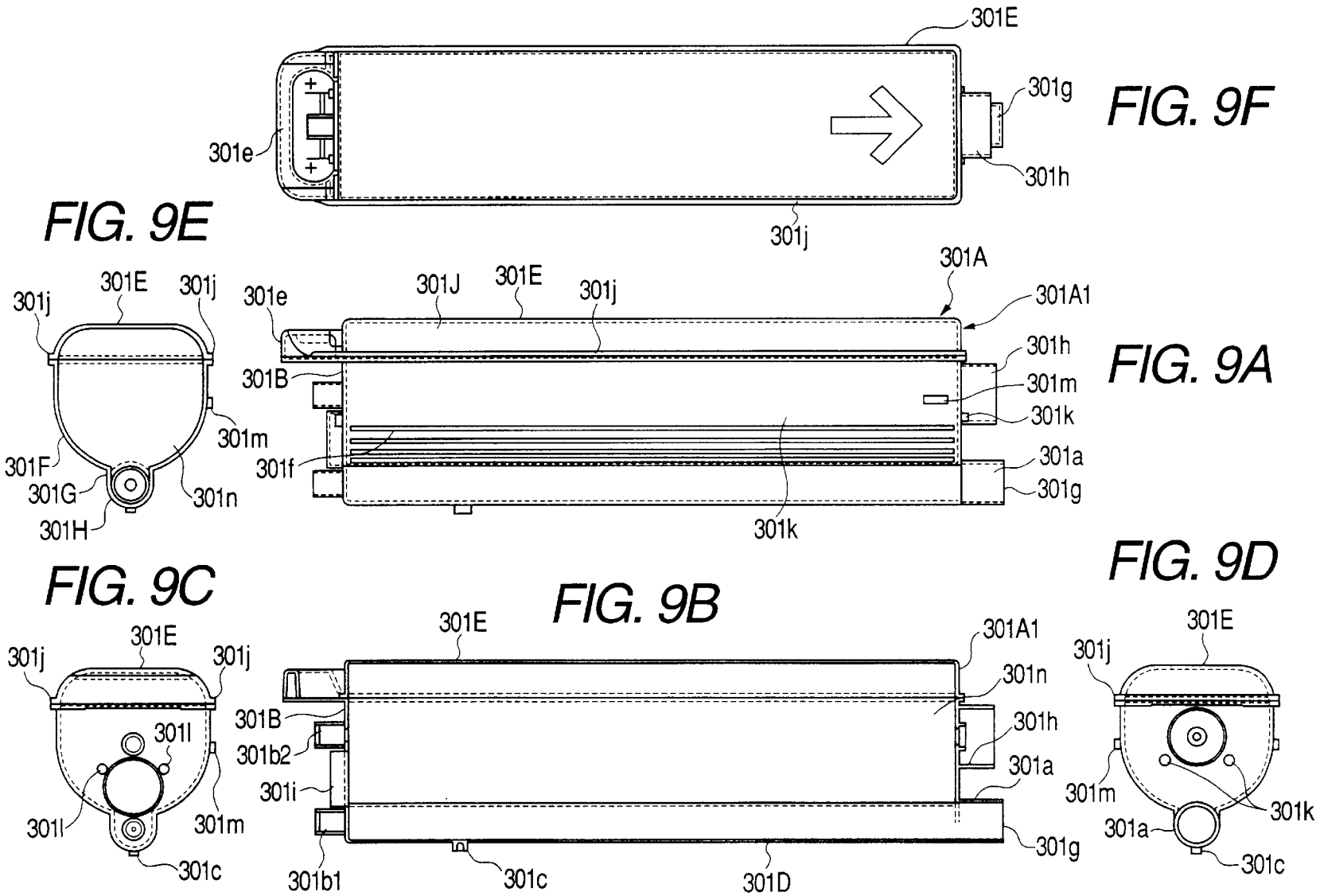
FIG. 9A is a front view.
FIG. 9B is a longitudinal sectional view.
FIG. 9C is a left side view.
FIG. 9D is a right side view.
FIG. 9E is a side sectional view and FIG. 9F is a plan view of the toner container part.

Furthermore, FIG. 9A is a front view, FIG. 9B is a sectional view, FIG. 9C is a left side view, FIG. 9D is a right side view, FIG. 9E is a side sectional view and FIG. 9F is a plan view of the main body of the container.

The main body 301A of the toner replenishing container has a curved portion 301F which is narrower toward a bottom, a straight portion 301G which is disposed under the curved portion and has a nearly definite width, and a semicircular portion 301H which is disposed under the straight portion 301G and has a nearly semicircular shape. Though it is preferable to manufacture the main body 301A of the container by a method such as injection molding, blow molding or injection blow molding of resin such as a plastic, the main body 301A may be manufactured by another method using a different material. Furthermore, it is preferable for manufacturing convenience to divide the main body 301A of the container into two or more parts and integrate these parts by means of welding, bonding or the like.

From a lower portion of a side surface 301A1 which is a wall surface intersecting with a rotation axis line of the agitating member 305 of the main body 301A of the container, a cylindrical toner replenishing aperture portion 301*a* is protruded for supplying the toner accommodated in a toner accommodating portion 301*n* to the main body 100 of the apparatus. Furthermore, a toner replenishing port 301*g* is disposed at an end of the toner replenishing aperture 301*a*. Furthermore, a first receiving portion 301*b*1 for rotatably holding the carrying member 302 is formed on the other side surface 301B at a location corresponding to the toner replenishing aperture portion 301*a*. Furthermore, disposed outside a bottom surface 301D is a positioning portion 301*c* which is to be positioned by the main body 100 of the apparatus when the toner replenishing container 301 is disposed in the main body 100 of the apparatus. This positioning portion 301*c* has a function also as an engaging portion 301*c* which is engaged with toner replenishing port opening/closing means (not shown) of a container receiving stand 50 disposed in the main body 100 of the apparatus and moves the toner replenishing container 301 in attaching and detaching directions. In this embodiment, the engaging portion 301*c* is a dowel which protrudes outward from the bottom surface 301D. The toner replenishing container 301 is mounted on a top surface 301E for replenishing the toner into the main body 100 of the apparatus. Furthermore, a grip 301*e* is disposed for use by the user to take out the toner replenishing container 301 from the main body 100 of the apparatus. Furthermore, grooves 301f are formed nearly in parallel with each other in the longitudinal direction of the main body 301A of the container to allow the user to easily grip the main body 301A of the container when the toner replenishing container 301 is disposed in the main body 100 of the apparatus. The curved portion 301F is a portion of a cylinder around a shaft portion 302A of the carrying member 302.

Furthermore, a second receiving portion 301*b*2 which rotatably supports the agitating member 305 is disposed over the first receiving portion 301*b*1 on the other side surface 301B.

In a side surface 301A1 on a side opposite to a side surface 301B on which the grip 301*e* is disposed, the toner replenishing aperture portion 301*a* is formed in a longitudinal direction of the main body 301A of the container.

Accordingly, the image forming apparatus is capable of preventing the toner replenishing aperture portion 301*a* from being touched by the user accidentally when the user disposes the toner replenishing container 301 in the main body 100 of the apparatus. Furthermore, the toner replenishing aperture portion 301*a* is formed in the lower portion of the side surface 301A1. Accordingly, the toner replenishing aperture portion 301*a* is capable of discharging the toner efficiently even when the toner is accommodated in a small amount in the main body 301A of the container.

The toner replenishing aperture portion 301*a* protrudes from the side surface 301A1 by a distance of 20 mm to 40 mm, preferably, approximately 27.8 mm. Furthermore, the toner replenishing aperture portion 301*a* has a cylindrical form which has an outer diameter of 20 to 30 mm, more preferably, 26 mm to 29 mm, most preferably approximately 27.6 mm.

Furthermore, the engaging portion 301*c* is disposed outside the bottom surface 301D as described above. This engaging portion 301*c* is positioned by an engaging portion disposed on the main body 100 of the apparatus when the toner replenishing container 301 is disposed in the main body 100 of the apparatus. This engaging portion 301*c* is the cylindrical dowel which protrudes outward from the bottom surface 301D as described above. This cylindrical portion has an outer diameter of 5 mm to 12 mm, preferably approximately 8 mm. The engaging portion 301*c* is provided at a location of 2 mm to 8 mm from the bottom surface 301D. In a longitudinal direction of the bottom surface 301D, the engaging portion 301*c* (positioning portion) is disposed at a location of 60 mm to 80 mm, preferably about 71 mm, as measured from an end surface 301B on a side opposite to a side on which the toner replenishing aperture portion 301*a* is located.

Though it is preferable that the engaging portion (positioning portion) 301*c* has a cylindrical form, the engaging portion 301*c* may have a shape of a prism or a semi-cylinder.

Disposed on the side surfaces 301A1 and 301B are two bosses 301*k* and two bosses 301*l* which were used for positioning the main body 301A of the container before factory shipment.

Furthermore, reference numeral 301m denotes a rib for preventing erroneous setting.

By disposing the rib 301*m* at a different location of each toner replenishing container 301, it is possible to prevent the user from setting another kind of toner replenishing container in the main unit 100 of the apparatus.

Though it is preferable to manufacture the main body 301A of the container by a method such as injection molding, blow molding or injection blow molding of resin such as a plastic, the main body 301A of the container may be manufactured by another method using a different material. For convenience, the main body 301A of the container may be divided into two or more parts and manufactured by integrating these parts by means of solvent welding or bonding.

In this embodiment, the main body 301A of the container was manufactured by vibration welding of two upper and lower frames which were prepared by injection molding of high-impact polystyrene.

Furthermore, as shown in FIG. 6 the carrying member 302 has a shaft portion 302A and a spiral rigid carrying blade 302B which is a carrying portion which is disposed around the shaft portion 302A and carries the powder toner in a predetermined direction when the shaft portion 302A is rotated. The carrying member 302 is attached to the main body 301A of the container in a condition where an axis line of the shaft portion 302A is nearly centered with a nearly circular toner replenishing port 301*g*.

The carrying member 302 is not limited to the so-called screw type which is described in this embodiment and may be, for example, of a flexible blade attached to the shaft portion 302A. The shaft portion and the blade may be molded integrally or separately. In this embodiment, the shaft portion 302A and the blade 302B are made of a plastic and molded integrally.

In this embodiment, the carrying member 302 has an extending portion 302*c* which is located in a cylindrical portion of the toner replenishing aperture portion 301*a* as shown in FIG. 7. In this embodiment, the extending portion 302*c* further protrudes outward from the toner replenishing aperture portion 301*a*. The extending portion 302*c* receives the rotating drive force from the main body 100 of the apparatus with a tip portion protruding outward. The closing member 303 is therefore attached to the tip portion so as to be movable in an axial direction in this embodiment.

An end portion (drive force receiving portion) 302*a* of the extending portion 302*c* is configured so as to have a shape capable of receiving the rotating drive force from the main body 100 of the apparatus via the closing member 303, a polygonal sectional shape, rectangular sectional shape in particular, in this embodiment. An end portion of the shaft portion 302A is supported by the closing member 303 by way of the end portion 302*a* of the extending portion 302*c*. Furthermore, a first bearing member 308 is fitted over the other end portion 302*b* of the shaft portion 302A. The carrying member 302 is rotatably supported by the main body 301A of the container by way of the first bearing member 308.

Furthermore, the carrying member 302 is supported by the closing member 303 in a condition where the carrying blade 302B is not in contact with an inside wall 301*a*1 of the toner replenishing aperture portion 301*a*, and an inside wall surface 301*a*1 of the toner replenishing aperture portion 301*a* and the end portion 302*a* of the shaft portion 302A are nearly horizontal. When the carrying member 302 is supported as described above, it is possible to carry the toner nearly horizontally toward the toner replenishing port 301*g* by rotating the carrying member 302. Furthermore, the fine toner is involved and strongly rubbed between the inside wall surface 301*a*1 of the toner replenishing aperture portion 301*a* and the carrying blade 302B, thereby making it possible to prevent the toner from being fused and fixed to the inside wall 301*a*1, and avoiding a phenomenon to produce coarse grains.

Though it is preferable to manufacture this carrying member 302 also by a method such as injection molding of resin such as a plastic as described above, the carrying member 302 may be manufactured by another method using a different material. Furthermore, the carrying member 302 may be optionally divided and joined.

Figure 10A:
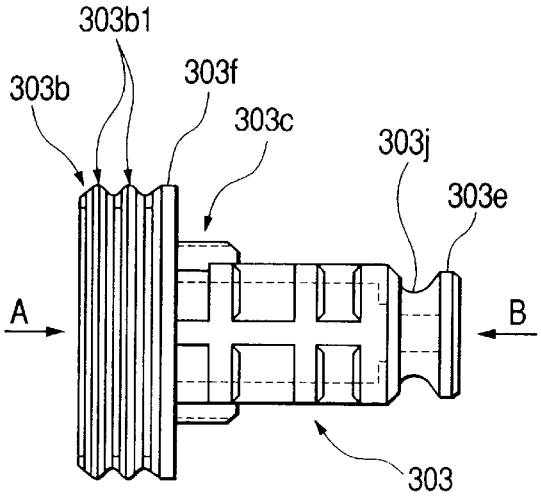
FIG. 10A is a front view of the closing member.

Now, a description will be made of the closing member 303 with reference to FIGS., 10A, 10B, 10C and 10D. FIG. 10A is a front view of the closing member, FIG. 10B is a sectional view taken in a direction indicated by an arrow A in FIG. 10A, FIG. 10C is a sectional view taken in a direction indicated by an arrow B in FIG. 10A and FIG. 10D is a front sectional view.

Figure 10B:
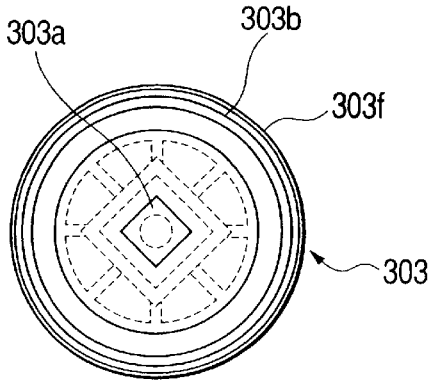
FIG. 10B is a sectional view taken in a direction indicated by an arrow A in FIG. 10A.
Figure 10C:
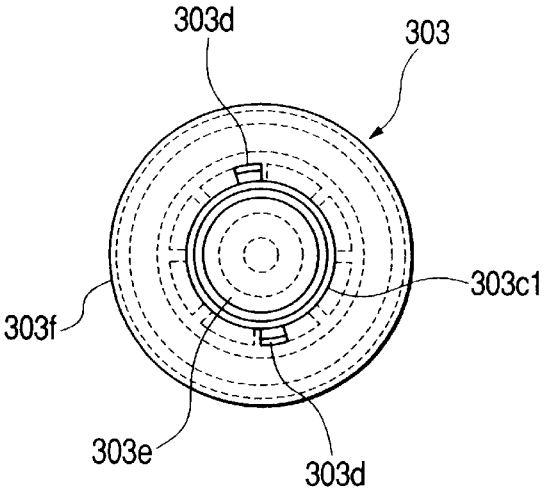
FIG. 10C is a sectional view taken in a direction indicated by an arrow B in FIG. 10A
Figure 10D:
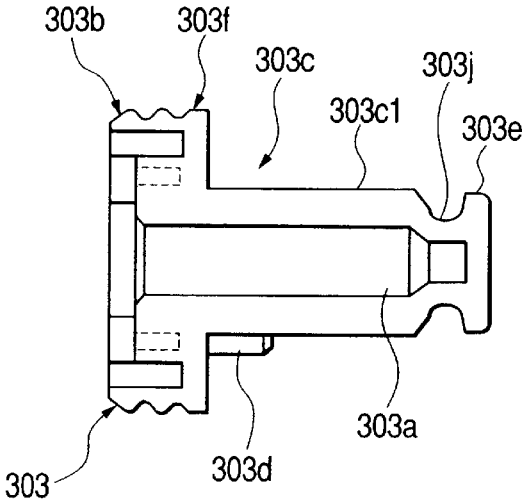
FIG. 10D is a front sectional view of the closing member shown in FIG. 10A.

In FIGS. 10A, 10B and 10D, reference numeral 303*b* denotes a closing portion which is disposed on the closing member 303 on a side opposed to the toner replenishing container 301 for unsealably sealing the toner replenishing port 301*g* of the toner replenishing container 301. The closing portion 303*b* has an outer diameter which is properly larger than an inner diameter of the toner replenishing port 301*g*. The closing member 303 tightly closes the toner replenishing port 301*g* when fitting portions 303*b*1 of circumferential protruding stripes of the closing portion 303*b* are pressedly fitted into the toner replenishing aperture portion 301*a* through the toner replenishing port 301*g*.

Furthermore, reference numeral 303*c* denotes a coupling engaging portion functioning as a driving force transmitting portion (driving portion) which receives a driving force for rotating the carrying member 302 from the main body 100 of the apparatus when the toner replenishing container 301 is disposed in the main body 100 of the apparatus. This coupling engaging portion 303*c* has a protruding portion 303*c*1 which is formed so as to extended from the closing portion 303*b* nearly coaxially with an axis line of the shaft portion 302A of the carrying member 302 in a direction away from the main body 301A of the toner container when the closing member 303 is set in the main body 301A of the container. This coupling engaging portion 303*c* has elongated (spline like) protrusions (rib) 303*d* which are formed on a circumferential surface of the protruding portion 303*c*1 and function as driving force receiving portions to be engaged with the coupling engaging portion 304. In this embodiment, the spline protrusions 303*d* are formed at two locations at equal intervals.

Specifically, two spline protrusions 303*d* are formed at intervals of approximately 180° around the longitudinal direction of the closing member 303.

Furthermore, the ribs 303*d* protrude 0.5 mm to 3 mm, preferably about 1.8 mm, from the protruding portion 303*c*1 of the closing member 303 in a radial direction.

Furthermore, the above described protruding portion 303*c*1 has an outer diameter of 10 mm to 14 mm, preferably about 12 mm.

The closing member 303 has an engaging hole 303*a* functioning as a driving force transmitting portion which engages with the end portion 302*a* of the carrying member 302 and transmits the driving force received from the main body 100 of the apparatus to the carrying member 302. The engaging hole 303*a* is configured by an opening (hollow portion) which is formed through a region of the closing portion 303*b* and the coupling engaging portion 303*c*. The engaging hole 303*a* has a rectangular shape corresponding to the rectangular shape of the shaft end portion 302*a* of the carrying member 302 which protrudes from the toner replenishing aperture portion 301*a*. The engaging hole 303*a* is formed slightly larger than the shaft end portion 302*a*, whereby the shaft end portion 302*a* is loosely fitted into the engaging hole 303*a*.

When the shaft end portion 302*a* is loosely fitted into the engaging hole 303*a* as described above, the carrying member 302 and the closing member 303 engage with each other in a rotating direction of the carrying member 302. On the other hand, the carrying member 302 and the closing member 303 are freely movable relative to each other in a direction of an axis line. Accordingly, the closing member 303 can be apart from the main body 301A of the container and the toner replenishing port 301*g* can be unsealed (opened) while the toner replen is hing container is disposed.

The engaging hole 303*a* and the shaft end portion 302*a* are engaged for a length sufficient for preventing disengagement when the closing member 303 is apart from the main body 301A of the container. Accordingly, the carrying member 302 can receive the driving force by way of the closing member 303 (the coupling engaging portion 303*c*) even when the closing member 303 is apart from the main body 301A of the container.

Disposed between the coupling engaging portion 303*c* and the closing portion 303*b* is a collar portion 303*f* which collides with an end of the toner replenishing aperture portion 301*a* when the closing portion 303*b* is pressedly fitted into the toner replenishing aperture portion 301*a*. The collar portion 303*f* has an outer diameter which is nearly equal to that of the toner replenishing aperture portion 301*a* (preferably smaller than that of the toner replenishing aperture portion 301*a*). The closing portion 303*b* is pressedly fitted into the toner replenishing aperture portion 301*a* by a length of the closing portion 303*b* using the collar portion 303*f*.

On the other hand, reference numeral 303*e* denotes an engaging protrusion which is formed on a tip of the coupling engaging portion 303*c* so as to be engaged with the engaging member 6 (see FIG. 6) disposed in the main body 100 of the apparatus. By engaging this engaging protrusion 303*e* with the engaging member 6, the closing member 303 can be fixed when the toner replenishing port 301*g* is to be opened.

Though it is preferable to manufacture the closing member 303 which has the above described configuration also by injection molding of resin such as a plastic, the closing member may be manufactured by another method using a different material or optionally divided and joined. Furthermore, the closing member 303 must have an appropriate elasticity since this member is pressedly fitted into the toner replenishing port 301*a* for tightly closing this port. As a material of the closing member 303, low-density polyethylene is most preferable and then polypropylene, nylon, high-density polyethylene, etc. are preferably usable.

Reference numeral 303*j* denotes a circumferential engaging groove into which the engaging member 6 disposed in the main body 100 of the apparatus is to be fitted. This engaging groove 303*j* has a width of 1.5 mm to 5 mm, preferably about 3 mm. In addition, the engaging groove 303*j* has a depth of 0.5 mm to 5 mm, preferably about 2.5 mm.

The closing member 303 has the nearly cylindrical fitting portion 303*b*1 which is to be fitted into the toner replenishing aperture portion 301*a* as described above. The closing member 303 has the collar portion 303*f* which is nearly coaxial with the fitting portion 303*b*1. Furthermore, the closing member 303 has a protruding portion 303*c*1 which protrudes nearly coaxially with the fitting portion 303*b*1 on an opposite side of the collar portion 303*f* to the side of the fitting portion 303*b*1, and the protrusion 303*d* of the driving force receiving portion is disposed at a root of the protruding portion 303*c*1. The engaging groove 303*j* is disposed at a protruding end of the protruding portion 303*c*1 and an engaging portion 303*e* is formed at the tip. Furthermore, the closing member 303 has a hollow portion formed from a side of the fitting portion 303*b*1 toward the engaging portion 303*e* and the engaging hole 303*a* is formed in this hollow portion as the driving force transmitting portion. Since the hollow portion is not open on a side of the engaging portion 303*e*, the toner cannot leak from the hollow portion outside the main body 301A of the container when the fitting portion 303*b*1 is fitted into the toner plenishing aperture portion 303*a*. Accordingly, the toner replenishing aperture portion 301*a* is closed by setting the closing member 303.

In this embodiment, the closing member 303 has four functions:

(1) a function to seal the toner replenishing aperture portion 301*a*, (2) a function to receive the rotating drive force from the main body 100 of the apparatus, (3) a function to transmit the rotating drive force to the carrying member 302 and (4) a function to engage with the engaging member 6 disposed in the main body 100 of the apparatus to open the toner replenishing aperture portion 301*a*. The closing member 303 is therefore capable of transmitting the drive force receives from the main body 100 of the apparatus to the shaft portion 302A by way of the extending portion 302*c*, thereby rotating the carrying member 302.

Figure 11D:
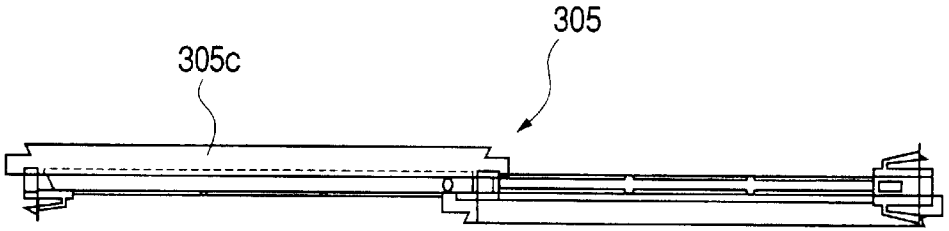
FIG. 11C is a left side view and FIG. 11D is a bottom view of an agitating member.
Figure 11A:
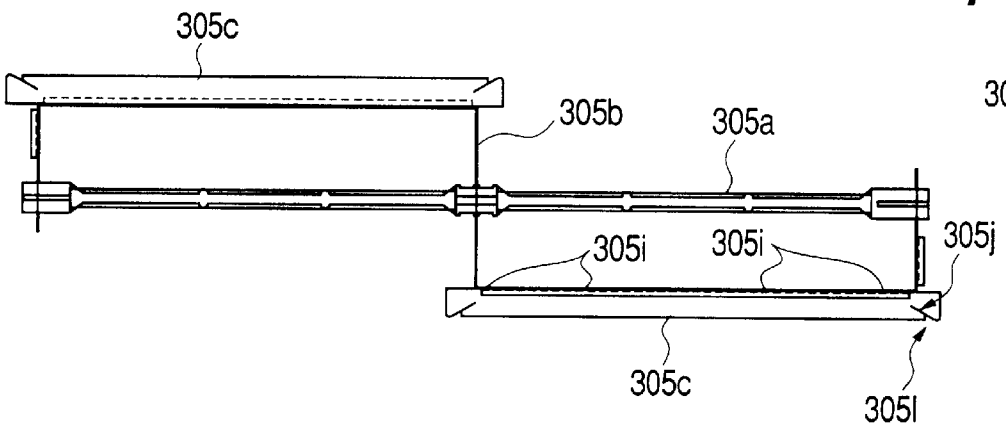
FIG. 11A is a front view.
Figure 11B:
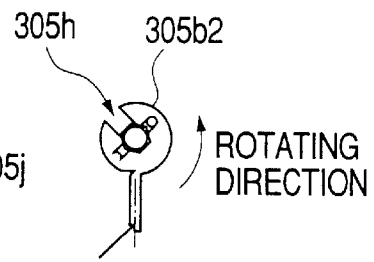
FIG. 11B is a right side view.
Figure 11C:
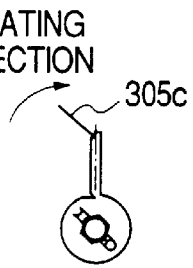
Figure 12:
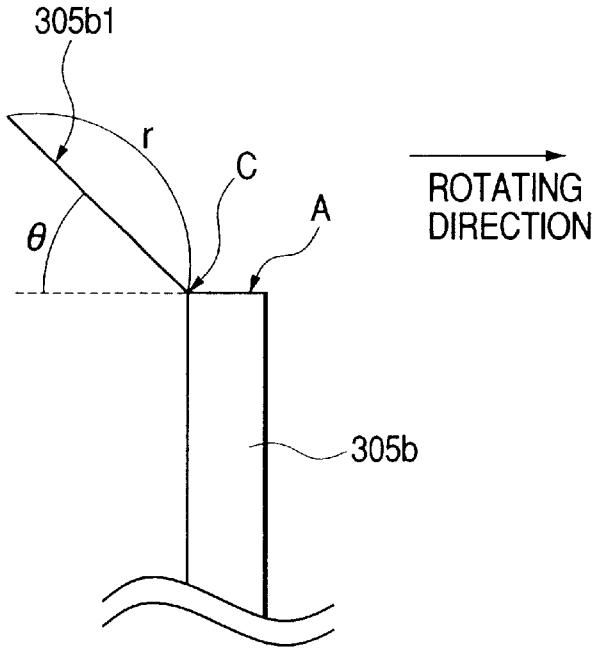
FIG. 12 is an enlarged side view of a rigid blade part.
Figure 13:
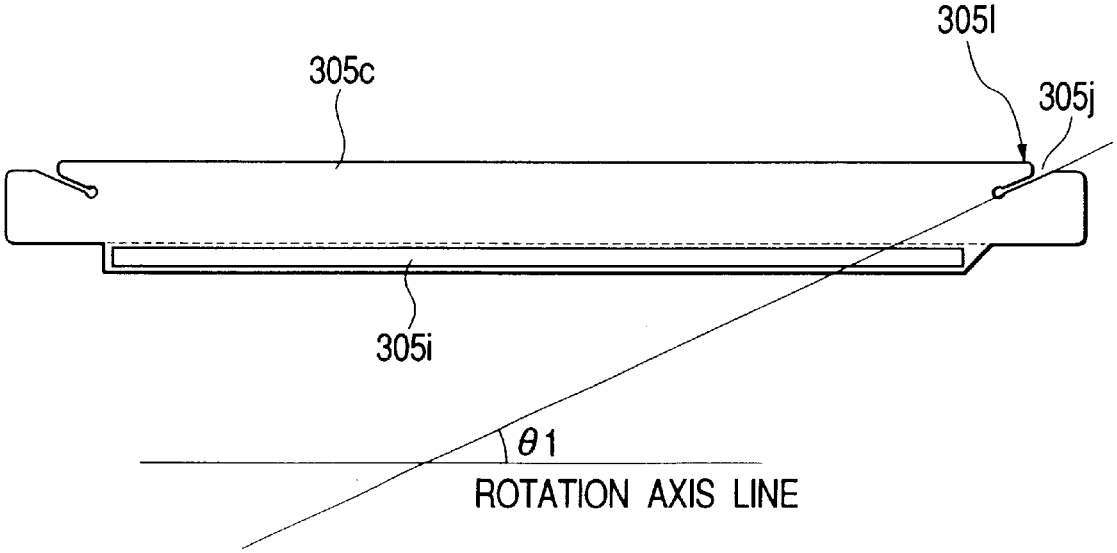
FIG. 13 is an enlarged view of a flexible blade part.

Now, a description will be made of the agitating member 305. FIG. 11A is a front view, FIG. 11B is a right side view and FIG. 11C is a left side view of the agitating member 305. The agitating member 305 has a shaft portion 305*a*, a rigid blade portion 305*b* and a flexible blade portions 305*c* which are agitating sheets as shown in FIGS. 11A to 11D. Furthermore, FIG. 12 is an enlarged view of the rigid blade portion 305 and FIG. 13 is an enlarged view of the flexible blade portion 305*c*. The shaft portion 305*a* is manufactured by injection molding of a plastic which has a relatively high rigidity. The rigid blade portion 305*b* is made of a metal such as stainless steel or a material which has a remarkably high rigidity, whereas the flexible blade portion 305*c* is made of a material having a low rigidity, for example, a plastic film or sheet, an elastomer sheet or the like. A polyester sheet is used in this embodiment.

An end 305*d* of the agitating member 305 engages with the above described transmitting member 306 in a bearing portion 301*h* of the main body 301A of the toner replenishing container. Furthermore, the other end 305*e* of the agitating member 305 engaged with a stopper member (second bearing member) 310 in the second receiving portion 301*b*2 of the main body 301A of the toner replenishing container. The shaft portion 305*a* is manufactured by injection molding of a plastic which has a relatively high rigidity in the embodiment, but a metal or the like may be used for manufacturing the shaft portion 305*a*.

Though integral molding of a metal or the like is preferable for simplicity and convenience of manufacturing the rigid blade portion 305*b*, the rigid blade portion 305*b* may be made of another material, manufactured by another method or divided into two or more parts and integrated by means of solvent welding or bonding. In the embodiment, a press-worked stainless steel sheet approximately 0.8 mm thick is used as the rigid blade portion 305*b*. A portion of the above described rigid blade portion 305*b* which is to be engaged with the above described shaft portion 305*a* has a shape which is adapted to the above described shaft portion 305*a* so that the rigid blade portion 305*b* is driven from the above described shaft portion 305*a*, and the rigid blade portion 305*b* rotates and agitates the toner in the container as the above described shaft portion 305*a* rotates.

A notch 305*h* which is formed in an end 305*b*2 of the rigid blade portion 305*b* as shown in FIGS. 11A to 11D facilitates assembly. Furthermore, a portion of the above described rigid blade portion 305*b* which is in parallel with the shaft portions 305*a* is configured entirely as a plate nearly in parallel with a tangent on a rotating locus and a portion of the blade portion 305*b* on a downstream side in a rotating direction is bent toward the inside wall of the toner replenishing container 301. However, it is preferable that a bent portion 305*b*1 shown in FIG. 12 has a length r on the order from 2 mm to 8 mm and a bending angle θ on the order of 30 degrees to 50 degrees. It is more preferable that the bent portion 305*b*1 has the length r on the order of 3 mm to 5 mm and the bending angle θ on the order of 45 degrees.

In this embodiment, the bent portion 305*b*1 has a length of approximately 3 mm and a bending angle of approximately 45 degrees. Furthermore, a distance as measured from a center of the rotation axis to a tip of the above described rigid blade portion may be appropriately determined dependently on a size of the main body 301A of the container and is preferably on the order of 70 to 95% of an inner diameter of the main body of the container. In this embodiment the, the distance is approximately 39.4 mm (89%) since the main body of the container has an inner diameter of approximately 44.5 mm. The bent portion 305*b*1 of the rigid blade portion 305*b* is apart from the inside wall surface of the main body 301A of the container.

The flexible blade portion 305*c* is made of a material having a low rigidity, for example, a member having flexibility such as a sheet of PET (polyethylene terephthalate), PE (polyethylene), PP (polypropylene), or PPS (polyphenylene sulfide). The flexible blade portion 305*c* has a thickness which is preferably on the order of approximately 50 μm to 500 μm, particularly preferably of 100 μm to 300 μm. In this embodiment a polyester sheet approximately 100 μm thick is used as the flexible blade portion 305*c*.

Figure 23:
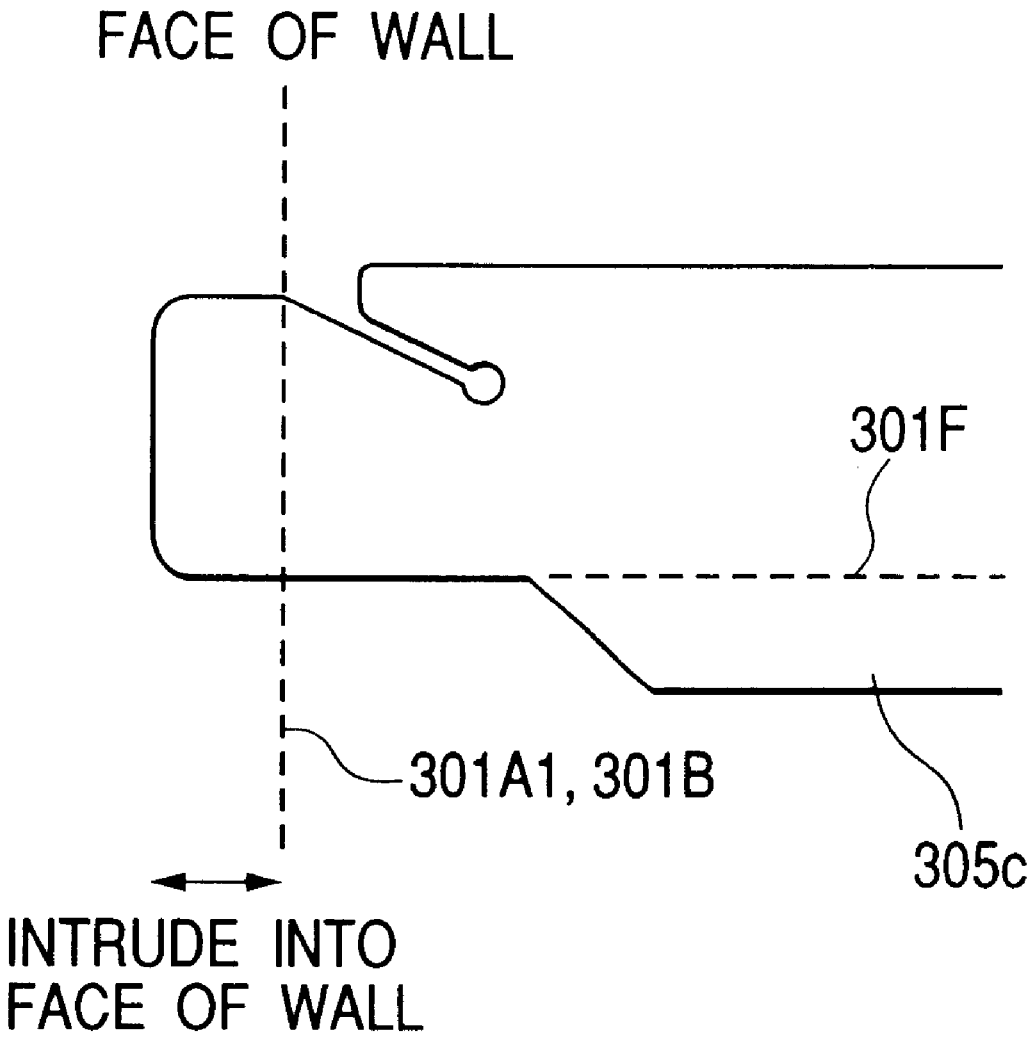
FIG. 23 is a front view showing signification of intrusion of a blade into a wall surface.

Furthermore, the flexible blade portion 305*c* has a tip which is bonded so as to be in contact with the inside wall surface of the container within a range of an entire length of the bent portion 305*b*1 of the rigid blade portion 305*b*. The flexible blade portion 305*c* rotates together with the above described rigid blade portion 305*b* while scraping off the toner from the inside wall of the container. The above described effect can be enhanced by configuring the flexible blade portion 305*c* so as to have a length in a rotation radial direction and a length in a direction of the wall surface nearly in parallel with the rotation axis line which are longer on the order of 0.5 to 15 mm longer than a distance as measured from a tip of the rigid blade portion 305*b* to the inside wall of the container. The agitating blade intrudes into the wall surfaces (inside wall of the curved portion 301F, the side surface 301A1 and the other side surface 301B) when the flexible blade portion 305*c* is configured so as to have the length in the rotating radial direction and the length in the direction of the wall surface nearly in parallel with the rotation radial line which are longer than the distance as measured from the tip of the rigid blade portion 305*b* to the inside wall surface of the container (see FIG. 23).

In this embodiment, the flexible blade portion 305*c* has a first sheet portion which has a shape extended so as to have a length in a direction of a circumferential wall of a curved portion 301F nearly in parallel with the rotation axis line which is 6 mm longer than the distance as measured from the tip of the rigid blade portion 305*b* and a second sheet portion which has a shape extended so as to have a length in a direction of the side wall surface 301A1 and the other side wall surface 301B intersecting with the rotation axis line which is 9 mm longer than the distance as measured from the tip of the rigid blade portion 305*b* to the in side wall surface of the container.

Furthermore, a slit 305*j* is formed in a portion of the agitating blade which is extended toward the wall surface intersecting with the rotation axis line so as to form an outside angle less than 90° relative to the rotation axis line. The outside angle relative to the rotation axis line is an angle θ1 shown in FIG. 13 which is 26° in this embodiment. Accordingly, deflection of the first sheet portion produces no influence on deflection of the second sheet portion.

Out of agitating blades divided by the slit 305*j*, a blade which is the first sheet portion for rubbing the circumferential wall nearly in parallel with the rotation axis line has such a shape as to extend its end nearly to a location of the wall surface intersecting with the rotation axis line and this shape provides a distance as measured from an end 305*l* of the blade intruding into the circumferential wall nearly in parallel with the rotation axis line to the inside wall surface of the side surface 301A1 or the other side surface 301B intersecting with the rotation axis line shown in FIGS. 11A to 11D and 13 which is within a range preferably from −5 mm to +5 mm, more preferably of −3 mm to +3 mm. The distance is 0.5 mm in this embodiment. The distances of −5 mm and −3 mm mean intruding distances of the blade of 5 mm and 3 mm respectively. Accordingly, it is possible to reduce the toner remaining on the wall nearly in parallel with the rotation axis line.

In the embodiment, the above described flexible blade portion 305*c* is bonded to the bent portion 305*b*1 of the above described rigid blade portion 305*b* using a both-side adhesive tape 305*i* (trade symbol DIC#8800CH) as shown in FIG. 13. The flexible blade portion 305*c* may be attached by conventionally known means such as riveting or caulking or may be molded integrally with the rigid blade portion 305*b*.

Though the rigid blade portion 305*b* is configured in a zigzag shape by dividing it at a nearly middle point so as to have a phase difference of 180 degrees relative to the axial direction in the embodiment, a division number may be appropriately determined dependently on a form and a length of the main body of the container and the rigid blade portion may be divided into three, four or more in the longitudinal or circumferential direction. Furthermore, the rigid blade portion 305*b* may be configured in a spiral shape by changing a phase continuously along a total length in the longitudinal direction. Furthermore, an assembling property is enhanced by forming notches 305*h* in both ends and a nearly middle portion of the above described rigid blade portion 305*b* which are to be engaged with the shaft portion as shown in the drawing. Furthermore, the above described bent portion 305*b*1 of the rigid blade portion 305*b* has a length of approximately 3 mm to narrow a projection area of the rigid blade portion 305*b* in the rotating direction and reduce resistance to the toner. Furthermore, it is preferable that a length r and a bending angle θ of the above described bent portion 305*b*1 are set preferably on the order of 2 to 8 mm and 30 to 50 degrees or more preferably on the order of 3 to 5 mm and approximately 45 degrees.

As means to join the above described rigid blade portion 305*b* to the flexible blade portion 305*c*, caulking of an aluminum rivet 305*i* may be adopted in place of the both-surface adhesive tape. In this case, it is preferable to perforate or half cut a portion of the flexible blade portion 305*c* which is to be brought into contact with the bent portion 305*b*1 of the rigid blade portion 305*b* since undulation may be caused even by a slight deviation of a rivet hole of the flexible blade portion 305*c*. Another conventionally known means such as a both-side adhesive tape may be used as means or bonding the blade portions.

Now, a description will be made of a method to assemble the toner replenis hing container 301.

To assemble the toner replenishing container 301, a lower portion of the lower frame 301*k* is first inserted into the carrying member 302 from above. After inserting the oil seal 309 into the first receiving portion 301*b*1, the bearing member 308 is engaged with the other end 302*b* of the carrying member 302. Furthermore, the toner replenishing port 301*g* is sealed with the closing member 303. Then, the agitating member 305 is inserted from above. After inserting the oil seal 309*a* into the main body 301A of the container, the second bearing member 310 and the transmitting member 306 are engaged with both ends of the agitating member 305. Then, the upper frame 301J is oscillation welded to the lower frame 301*k*.

Then, a predetermined amount of toner is charged into the main body 301A of a container through the toner charging port 301*i* of the main body of the toner replenishing container 301 and toner charging port 301*i* is closed by the closing member 311 to complete the assembly of the toner replenishing container 301. The toner replenishing container 301 can be assembled extremely conveniently and requires a remarkably small number of assembling procedures as described above.

In addition, the toner may be charged through the toner replenishing port 301*g*.

Figure 14:
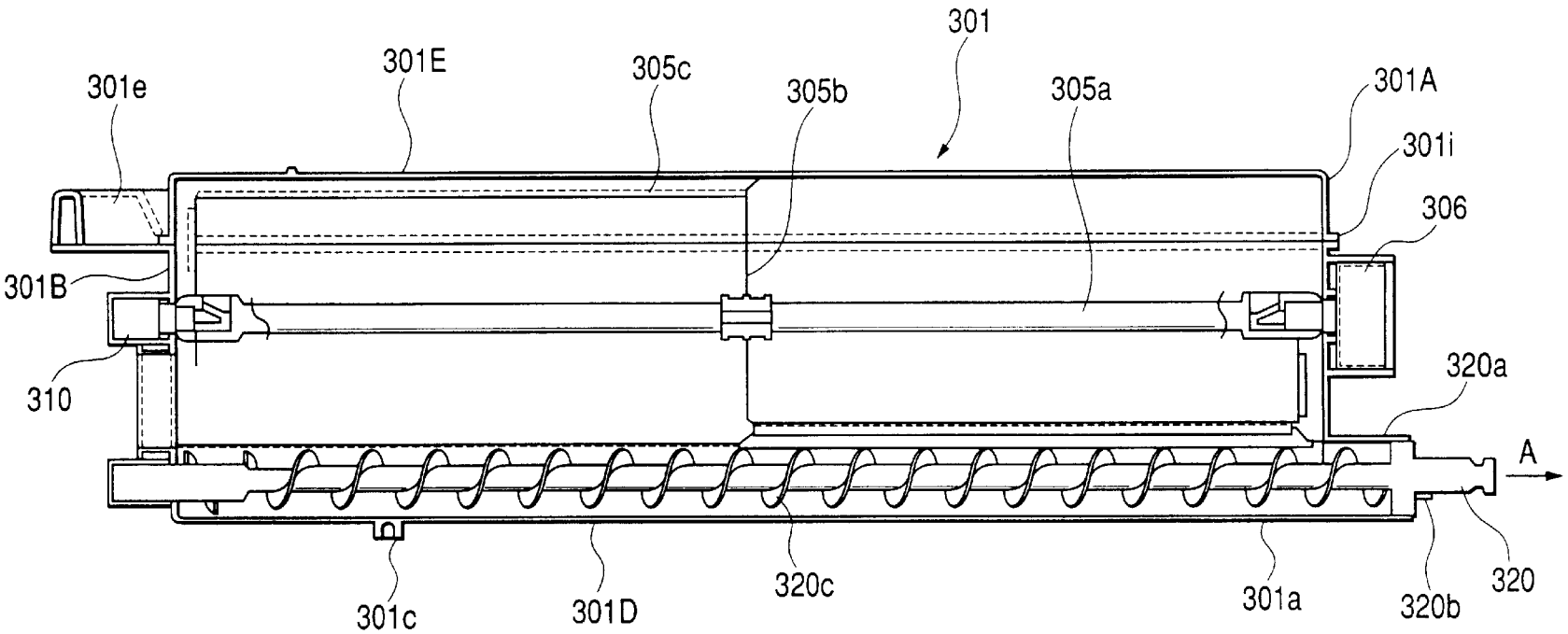
FIG. 14 is a longitudinal sectional view showing an example where the closing member and a carrying member are configured integrally with each other.

Though the closing member 303 is configured to be movable relative to the carrying member 303 in a direction of an axis line in the embodiment, a closing member and a carrying member may be integrated as shown in FIG. 14. In FIG. 14, a closing member 320 has a closing portion 320*a*, a driving force receiving portion 320*b* and a toner carrying portion 320C. The closing member 320 is configured to be movable relative to a main body 310A of a container in a direction indicated by an arrow A in FIG. 14. The closing portion 320*a* is opened by moving the closing member 320 in the direction indicated by the arrow A. This movement is caused by a movement of an engaging member 6 after the toner replenishing container 301 is disposed and fixed.

Figure 15A:
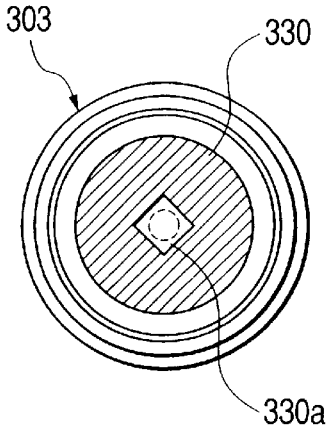
FIG. 15A is a front view.
Figure 15B:
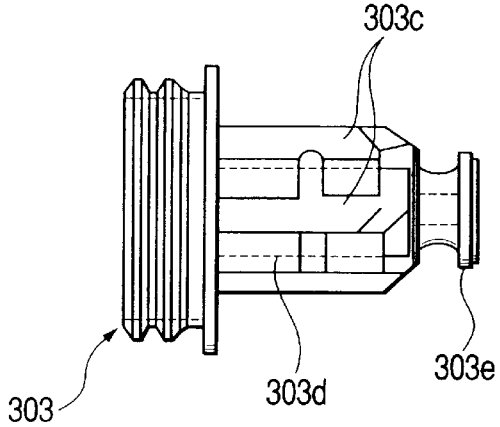
FIG. 15B is a side view and FIG. 15C is a side sectional view of a closing member which has a sealing member.
Figure 15C:
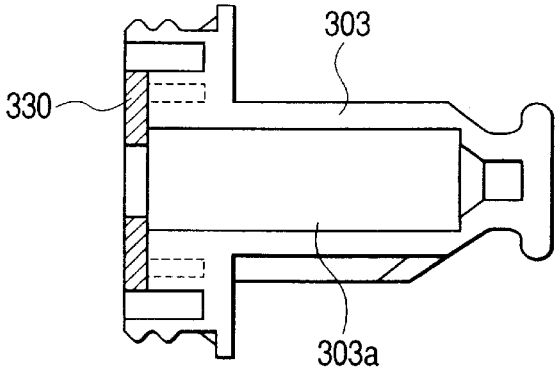

Furthermore, a seal member may be disposed on the above described driving portion (driving force transmitting portion) of the sealing member 303. FIGS. 15A, FIG. 15B and FIG. 15C are a front view, a side view and a side sectional view respectively of a closing member which has a sealing member.

Reference numeral 330 denotes a disk like sealing member which has a rectangular hole 330*a* corresponding to a shape of a shaft end portion 302*a* of the agitating member 302. In the embodiment, a sectional shape of the hole 330*a* is square like that of the shaft end portion 302*a*. The sealing member 330 is disposed on a side opposed to the main body 301A of the container of the closing member 303 and configured so that the shaft end portion 302*a* of the agitating member 302 is loosely fitted into the hole 303*a* through the hole 330*a*.

Figure 16A:
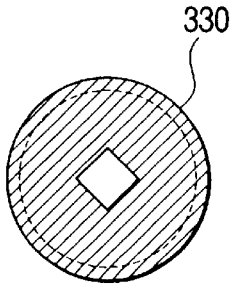
FIG. 16A is a front view of the sealing member seen from the container side and FIG. 16B is a front view of the sealing member seen from the closing member side.
Figure 16B:
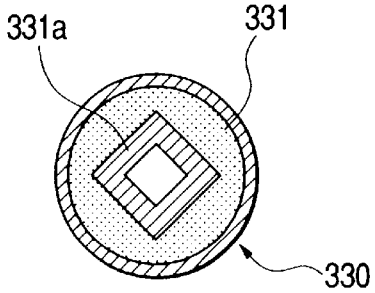

FIGS. 16A and 16B show a front view of the sealing member 330 used in the embodiment. Reference numeral 331 denotes a both-side adhesive tape which is disposed on a side opposite to the closing member 303 of the sealing member 330. The both-surface adhesive tape 331 has a hole 331*a* so that the shaft end portion 302*a* passes through not only the hole 330*a* but also the hole 331*a* when the shaft end portion 302*a* is loosely fitted into the hole 303*a*. Furthermore, the hole 331*a* is configured to have a sectional shape larger than the hole 330*a* so that the both-surface adhesive tape 331 will not be brought into contact with the shaft end portion 302*a*. Though the closing member 303 and the sealing member 330 are fixed with the both-surface adhesive tape, the closing member 303 and the sealing member 330 may be integrated with each other by two-color molding or insert molding as another fixing method.

Figure 17:
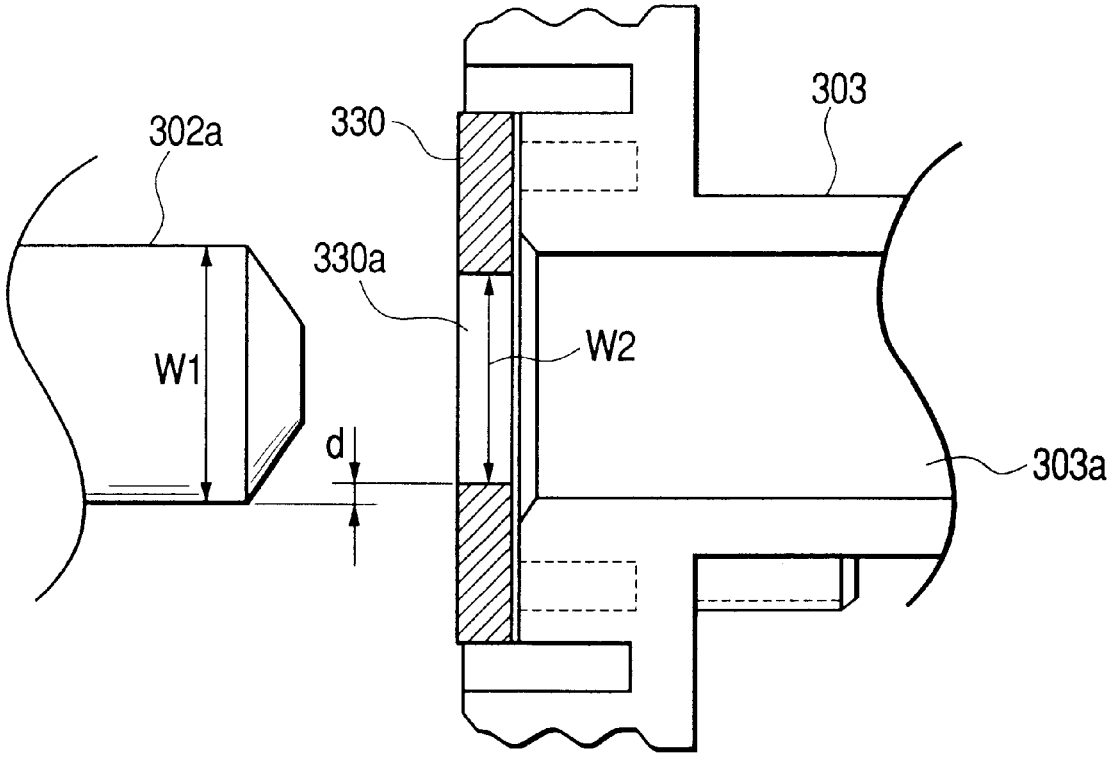
FIG. 17 is an enlarged side view of the carrying member and the closing member.

FIG. 17 is an enlarged view of the carrying member 302 and the closing member 303 used in the embodiment. The hole 330*a* has a diameter (W2) is smaller than a shaft diameter (W1=6 mm) of the shaft end portion 302*a* and it is specifically preferable that a difference (d) between W1 and W2 is 0.5 mm to 2 mm. In the embodiment, W2=5 mm and d=W1−W2=1 mm. Taking a sealing property and an assembling property into consideration, it is preferable that the sealing member 330 has a thickness of 0.5 mm to 5 mm. It is more preferable to use a sealing member which has a thickness of 1 mm to 3 mm. In the embodiment, the sealing member 330 has a thickness of approximately 2 mm. Similarly taking the sealing property and the assembling property into consideration, it is preferable that a material of the sealing member 330 is a soft elastic material, and a lowly expandable polyurethane which has hardness of 20 to 70°, compressive permanent set not higher than 4%, a coefficient of friction p not larger than 0.8, a cell size of 60 to 300 μm and a specific weight of 0.2 to 0.5 is used in the embodiment.

Toner discharge tests were effected using the toner replenishing container having the above described configuration. The toner discharge tests were effected after charging 1650 g of a toner (positive toner having a black component for an applicant company type No. GP605) and repeating tapping 1000 times assuming commercial circulation in an inverted condition like that for evaluation of commercial products.

FIGS. 20A to 20D show a comparative example of the agitating member 305. A flexible blade 305*c* has a flexible blade portion 305*cc* to be brought into contact with an inner circumferential wall of a main body 301A of a container and a flexible blade portion 305*ca* to be brought into contact with an inside wall perpendicular to an agitating shaft 305*a* of the main body 301A of the container which are separated from each other.

A toner replenishing container which had the agitating member 305 shown in FIGS. 20A to 20D allowed the toner to remain in amounts of 30.5 to 44.6 g (36.5 g in average), whereas a toner replenishing container which used the agitating blade according to the embodiment of the present invention (having the agitating member 305 shown in FIGS. 11A to 11D) and in which the agitating blades intruding into the wall surfaces intersecting with the rotation axis line (two shorter blades 302*c* in FIGS. 20A to 20D) were omitted allowed the toner to remain in amounts of 29.7 g to 42.3 g (37.4 g in average), which were equalled to those in the comparative example in spite of the omission of the two shorter agitating blades (the two shorter agitating blades 305*c* in FIGS. 20A to 20D) intruding into the wall surfaces perpendicular to the rotation axis line. Furthermore, production levels of coarse grains were not different between the toner replenishing container according to the embodiment and the comparative example.

Comparative examples will further be described below.

Discharge tests effected using a toner replenishing container in which agitating blades for rubbing the wall surfaces intersecting with the rotation axis line (the two shorter agitating blades 305*ca* in FIGS. 20A to 20D) were omitted indicated residual amounts of 46.4 g to 49.9 g (48.5 g in average), which were apparently larger than the residual amounts of 30.5 g to 44.6 g (36.5 g in average) in the container shown in FIGS. 20A to 20D.

Figure 21:
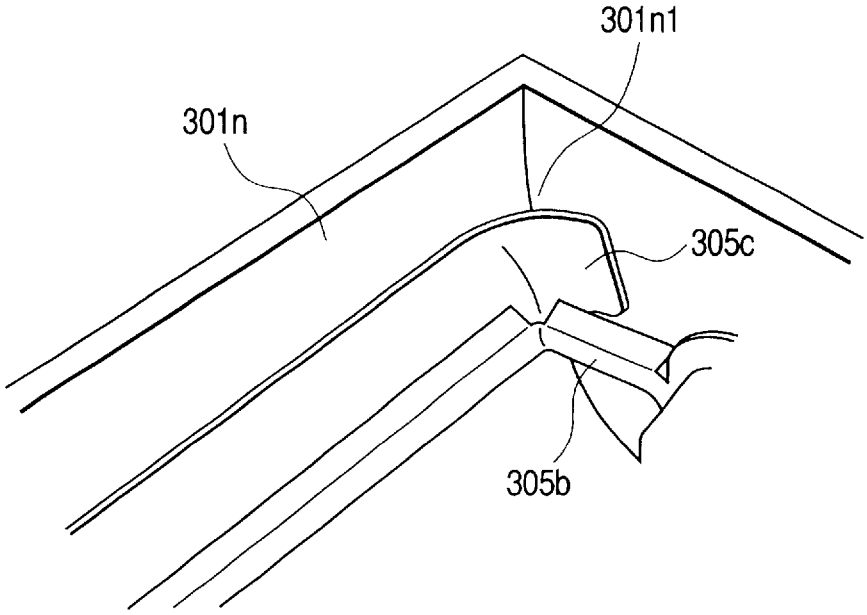
FIG. 21 is a perspective view showing a rubbed condition of a corner of a toner container with an agitating blade having a shape which is only extended so as to rub both a circumferential wall nearly in parallel with an agitating axis line and a wall surface not in parallel with the agitating axis line.
Figure 22:
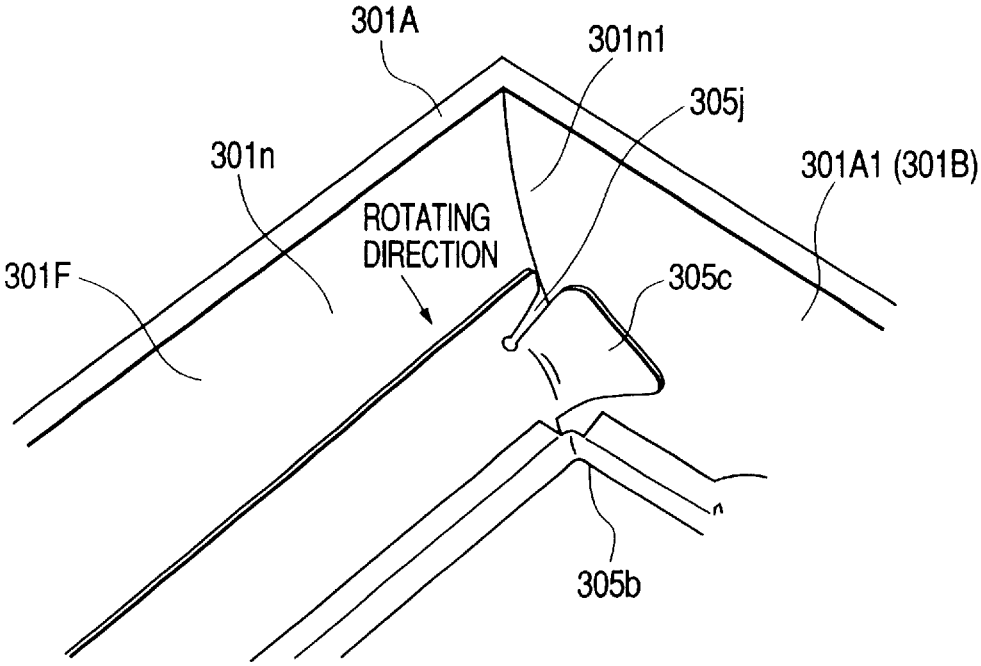
FIG. 22 is a perspective view showing a rubbed condition of a corner of a toner container with an agitating blade having a shape which is extended so as to rub both the surface nearly in parallel with the agitating axis line and the wall surface not in parallel with the agitating axis line, and slit so as to form an angle smaller than 90° between a slit and the agitating axis line.

In a case where the above described agitating blades have shapes which are simply extended so as to intrude into the wall surfaces which are nearly in parallel with the rotation axis line and the wall surfaces intersecting with the rotation axis line (FIGS. 19A to 19E), the agitating blade cannot go into a gap in the end corner 301*n*1 of the toner accommodating portion 301*n* as shown in FIG. 21, thereby increasing an amount of the toner which cannot be discharged with the agitating blade. When the slit 305*j* is formed, however, the agitating can go into the gap of the end corner 301*n*1 as shown in FIG. 22, thereby reducing a residual amount of the toner to that in the comparative example shown in FIGS. 20A to 20D.

An effect of the agitating blade according to the present invention will be apparent from this result.

(Second Embodiment)

Description of the first embodiment will be adopted for members having functions which are the same as those in the first embodiment.

Figures 18A, 18B, 18C, 18D, 18E:
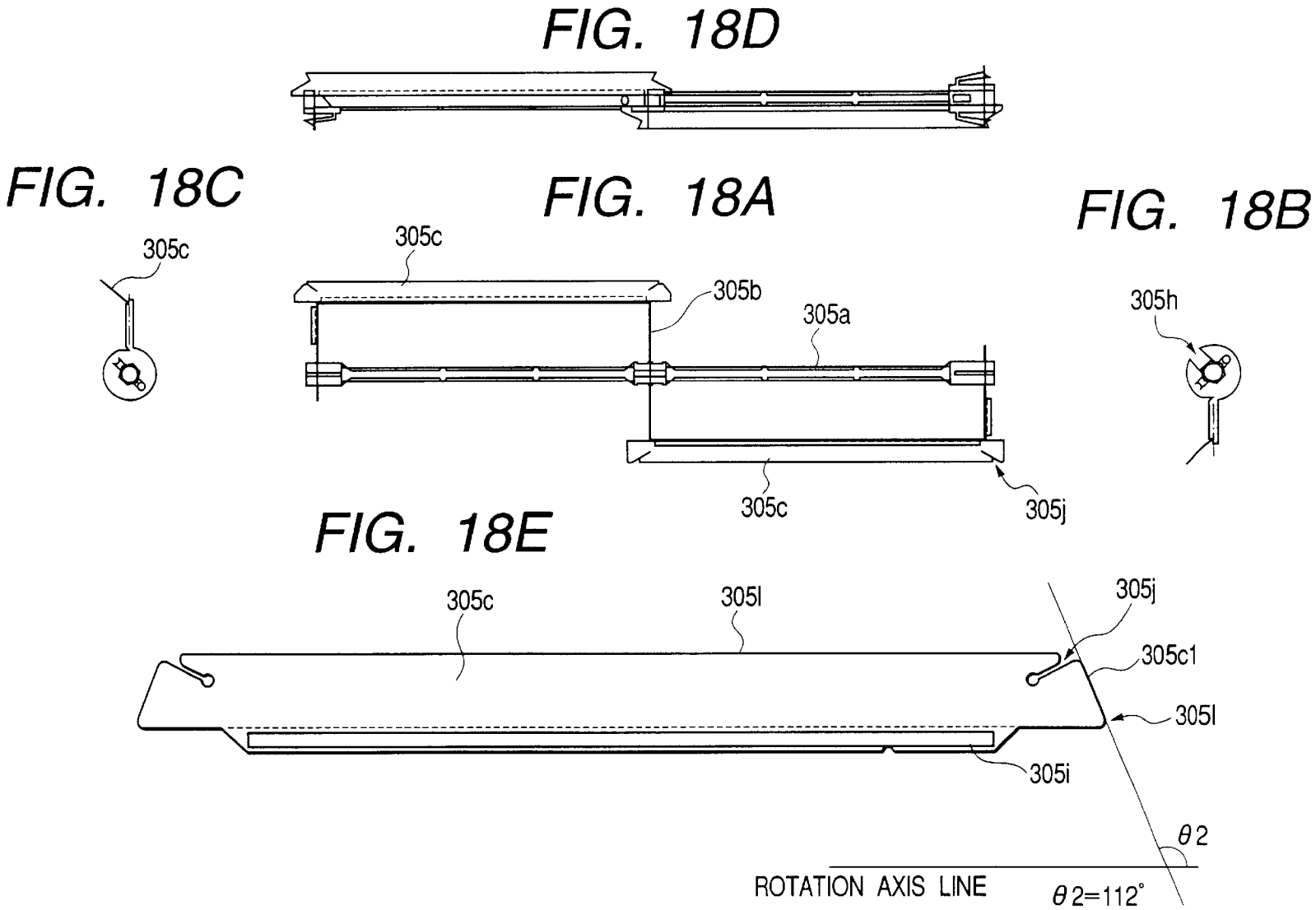
FIG. 18A is a front view.
FIG. 18B is a right side view and FIG. 18C is a left side view.
FIG. 18D is a bottom view of an agitating member according to a second embodiment.
FIG. 18E is a general view of an agitating blade.
Figure 19D:
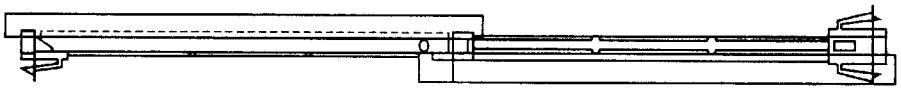
FIG. 19C is a left side view and FIG. 19D is bottom view of an agitating member having a shape extended so as to intrude into two wall surfaces shown in a comparative example and equipped with agitating blades which are not slit.
Figure 19A:
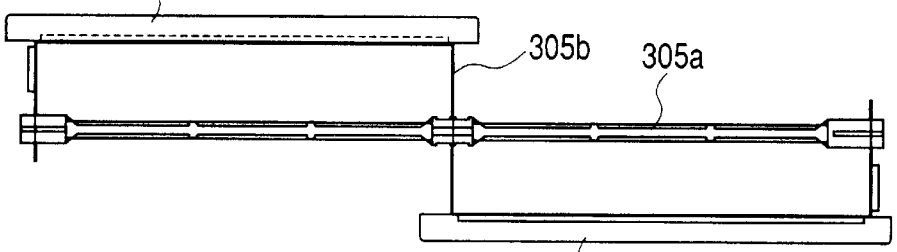
FIG. 19A is a front view.
Figure 19B:
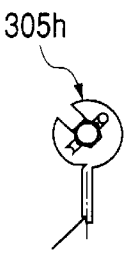
FIG. 19B is a right side view.
Figure 19C:
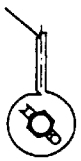
Figure 19E:
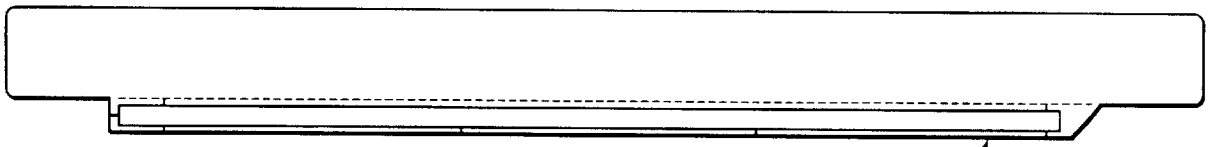
FIG. 19E is a general view of the agitating blade.
Figure 20A:
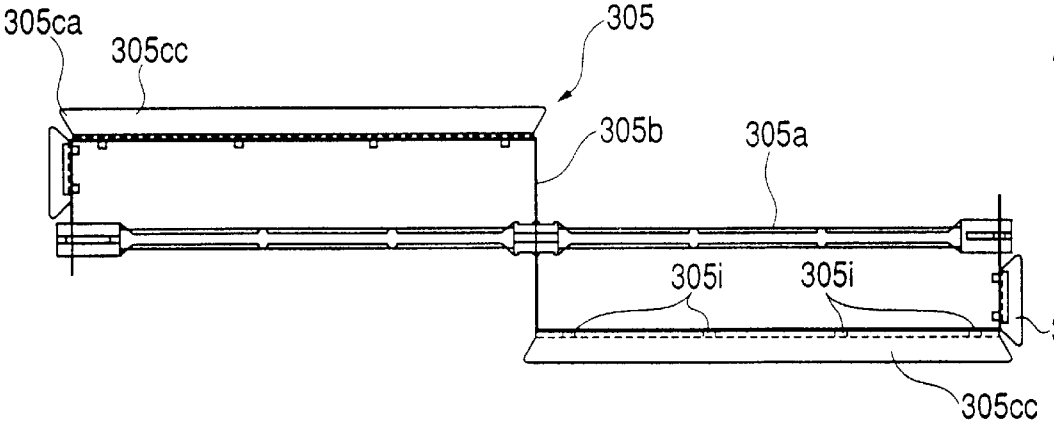
FIG. 20A PRIOR ART
FIG. 20A is a front view.
Figure 20B:
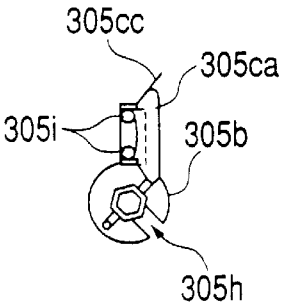
FIG. 20B PRIOR ART
FIG. 20B is a left side view.
Figure 20C:
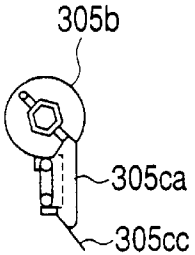
FIG. 20C PRIOR ART
FIG. 20C is a right side view and FIG. 20D is a bottom view of a currently used agitating member which is equipped with four agitating blades described above.
Figure 20D:
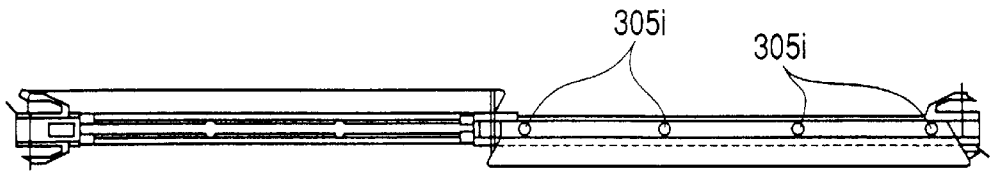
FIG. 20D PRIOR ART

FIG. 18A is a front view, FIG. 18B is a plan view and FIG. 18C is a side view of an agitating member using extended blades to which a second embodiment of the present invention is applied.

The extended blade is not only extended in a direction nearly in parallel with the rotation axis line and has a slit 305*j* formed from a side of a blade intruding into the wall surface intersecting with the rotation axis line but also a second sheet portion out of first and second blade portions divided by the slit 305*j* which rubs the wall surface intersecting with the rotation axis line has a shape slanted so as to increase an intruding depth near the rotation axis and reduce the intruding depth toward a tip and form an angle θ2 more than 90° between an edge 305C1 intruding into the wall surface intersecting with the rotation axis line and an end side 305*l* which is a portion intruding into the circumferential wall nearly in parallel with an agitation axis line. This shape allows a line formed by the sheet portion to move in a direction of a tangential line on an agitating rotation when the second sheet portion intrudes into the wall surface of the container, thereby restraining coarse grains from being produced.

The angle betwe en the portion intruding into the wall surface intersecting with the rotation axis line and the portion intruding into the circumferential wall nearly in parallel with the agitation axis line is the angle θ2 shown in FIG. 18E and this angle is 112° in the second embodiment.

The agitating member having the above described configuration is assembled in the toner replenishing container as described in the first embodiment.

Also in the second embodiment, the flexible blade portion has the first sheet portion for the circumferential wall nearly in parallel with the agitation axis line which has a shape extended so as to be 6 mm longer than the distance as measured from the tip of th e rigid blade portion to the inside wall of the container and the second sheet portion for the wall surface not in parallel with a longitudinal direction which has a shape extended so as to be 9 mm longer at maximum than the distance from the tip of the rigid blade portion to the inside wall of the container. However, the above described distance may be optional within a range from 0.5 mm to 15 mm. A reason is that a sufficient effect is obtainable with an extension only of 0.5 mm since actual play and intersection between the above described main body 301A of the container and the above described rotating member are not so large though a total of a play and an tolerance between the main body of the container and the agitating member which is ±2.3 mm and +2.3 mm to 15 mm may actually be better. Furthermore, a tendency to produce coarse grains in an amount larger than that in the example shown in FIGS. 20A to 20D was observed when the sheet portions were extended 15 mm or longer than the distance from the inside wall of the container.

Toner discharge tests which were effected using the toner replenishing contained according to the second embodiment in conditions which were the same as those indicated residual amounts of the toner of 28.6 g to 43.6 g (36.2 g in average) which were equal to those in the toner replenishing contained according to the first embodiment, but production levels of coarse grains improved as compared with those of the toner replenishing contained according to the first embodiment.

The first embodiment allowed 2 to 4 coarse grains to be produced, whereas the second embodiment allowed 1 to 3 coarse grains to be produced.

The agitating sheet having a continuous shape and slit so as to have the first sheet portion intruding not only into the wall surfaces intersecting with the rotation axis line but also into the wall surface nearly in parallel with the rotation axis line and a second sheet intruding into the wall surfaces intersecting with the rotation axis line allows an agitating blade to intrude into the gap at the end corner portion of the above described toner accommodating portion, thereby making it possible to omit agitating blades for intruding into the wall surfaces intersecting with the rotation axis line. That is, it becomes possible to reduce a number of parts of a toner replenishing container and provide an inexpensive toner replenishing container.

What is claimed is:

1. A rotatable agitating sheet for agitating a developer contained in a developer container, comprising:

a first sheet portion for rubbing an inside wall of said developer container substantially in parallel with a rotation axis of said agitating sheet;

a second sheet portion for rubbing an inside wall of said developer container intersecting with the rotation axis line of said agitating sheet, said second sheet portion being continuous to said first sheet portion; and a slit extending inward from an end of said agitating sheet and being formed between said first sheet portion and said second sheet portion.

2. An agitating sheet according to claim 1, wherein an outside angle between said slit and said rotation axis line is less than 90°.

3. An agitating sheet according to claim 1, wherein an end of said first sheet portion extends to the inside wall of said developer container substantially intersecting with said rotation axis line.

4. An agitating sheet according to claim 1, wherein said second sheet portion has a shape which is slanted relative to the inside wall of said developer container intersecting with said rotation axis line so that an intruding depth is smaller as said second sheet portion is farther from a vicinity of said rotation axis line.

5. An agitating sheet according to claim 1, further comprising a support portion which is supported by a rotatable support member.

6. An agitating sheet according to claim 1, said agitating sheet being made of polyethylene terephthalate, polyethylene, polypropylene or polyphenylene sulfide.

7. An agitating sheet according to claim 1, said agitating sheet having a thickness of 50 to 500 $\mu$m.

8. A developer container detachably attachable to a main body of an image forming apparatus, comprising:

a container for containing a developer;

an aperture portion for discharging the developer from said container; and a rotatable agitating sheet for agitating the developer contained in said container, said agitating sheet including:

a first sheet portion for rubbing an inside wall of said developer container substantially in parallel with a rotation axis line of said agitating sheet;

a second sheet portion for rubbing an inside wall of said developer container intersecting with the rotation axis line of said agitating sheet, said second sheet portion being continuous to said first sheet portion; and a slit extending inward from an end of said agitating sheet and being formed between said first sheet portion and said second sheet portion.

9. A developer container according to claim 8, wherein an outside angle between said slit and said rotation axis line is less than 90°.

10. A developer container according to claim 8, wherein an end of said first sheet portion extends to an inside wall of said developer container substantially intersecting with said rotation axis line.

11. A developer container according to claim 8, wherein said second sheet portion has a shape slanted relative to said inside wall of said developer container intersecting with said rotation axis line so that an intruding depth is smaller as said second sheet portion is farther from a vicinity of said rotation axis line.

12. A developer container according to claim 8, wherein said agitating sheet has a support portion which is supported by a rotatable support member.

13. A developer container according to claim 8, wherein said agitating sheet is made of polyethylene terephthalate, polyethylene, polypropylene or polyphenylene sulfide.

14. A developer container according to claim 8, wherein said agitating sheet has a thickness of 50 to 500 $\mu$m thick.

15. A developer container according to claim 8, wherein said developer container has a carrying member which is disposed below said agitating sheet for carrying the developer and said aperture portion is formed at an end of said carrying member.

* * * * *

UNITED STATES PATENT AND TRADEMARK OFFICE

CERTIFICATE OF CORRECTION

PATENT NO. : 6,418,290 B1
DATED : July 9, 2002
INVENTOR(S) : Tetsuo Isomura et al.

It is certified that error appears in the above-identified patent and that said Letters Patent is hereby corrected as shown below:

Title page,
Item [57], ABSTRACT,

"The present invention provides a rotatable agitating sheet for agitating a developer contained in a developer container, which has a first sheet portion for rubbing an inside wall of the developer container substantially in parallel with a rotation axis of the agitating sheet, a second sheet portion for rubbing an inside wall of the developer container intersecting with the rotation axis line of the agitating sheet, the second sheet portion being continuous to the first sheet portion, and a slit extending inward from an end of the agitating sheet and being formed between the first sheet portion and the second sheet portion."

should read

-- A rotatable agitating sheet for agitating a developer is contained in a developer container, which has a first sheet portion for rubbing an inside wall of the developer container substantially in parallel with a rotation axis of the agitating sheet, and a second sheet portion for rubbing an inside wall of the developer container intersecting with the rotation axis line of the agitating sheet. The second sheet portion is continuous to the first sheet portion. A slit extends inward from an end of the agitating sheet and is formed between the first sheet portion and the second sheet portion. --.

Column 1,
Line 65, "1Og" should read -- 10g --.

Column 11,
Line 4, "receives" should read -- received --.

Column 12,
Line 5, "the" (first occurrence) should be deleted; and
Line 52, "in side" should read -- inside --.

Column 13,
Line 54, "replenis hing" should read -- replenishing --.

Column 15,
Line 7, "p" should read -- $\mu$ --.

UNITED STATES PATENT AND TRADEMARK OFFICE

CERTIFICATE OF CORRECTION

PATENT NO. : 6,418,290 B1
DATED : July 9, 2002
INVENTOR(S) : Tetsuo Isomura et al.

It is certified that error appears in the above-identified patent and that said Letters Patent is hereby corrected as shown below:

Column 16,
Line 12, "near the rotation axis and" should be deleted;
Line 13, "reduce the intruding depth" should be deleted;
Line 23, "betwe en" should read -- between --; and
Line 35, "th e" should read -- the --.

Signed and Sealed this

Eleventh Day of February, 2003

JAMES E. ROGAN
*Director of the United States Patent and Trademark Office*